US012240723B2

(12) United States Patent
Niwa et al.

(10) Patent No.: US 12,240,723 B2
(45) Date of Patent: Mar. 4, 2025

(54) MEDIUM FEEDING DEVICE AND MEDIUM PROCESSING DEVICE INCLUDING THE SAME

(71) Applicant: FUJIFILM Business Innovation Corp., Tokyo (JP)

(72) Inventors: Masahito Niwa, Kanagawa (JP); Yuya Chonabayashi, Kanagawa (JP); Tatsuya Yamashita, Kanagawa (JP); Junki Kazama, Kanagawa (JP); Megumi Murakami, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 113 days.

(21) Appl. No.: 17/903,148

(22) Filed: Sep. 6, 2022

(65) Prior Publication Data

US 2023/0312278 A1 Oct. 5, 2023

(30) Foreign Application Priority Data

Mar. 29, 2022 (JP) ..... 2022-053794

(51) Int. Cl.
*B65H 3/08* (2006.01)
*B65H 3/48* (2006.01)

(52) U.S. Cl.
CPC ..... *B65H 3/0816* (2013.01); *B65H 3/08* (2013.01); *B65H 2301/4461* (2013.01); (Continued)

(58) Field of Classification Search
CPC ..... B65H 3/08; B65H 3/0816; B65H 3/0825; B65H 3/12; B65H 3/124; B65H 3/128; (Continued)

(56) References Cited

U.S. PATENT DOCUMENTS 4,451,028 A * 5/1984 Holmes ..... B65H 3/128 271/93
6,244,586 B1 * 6/2001 Gauger ..... B65H 3/0825 271/106

(Continued)

FOREIGN PATENT DOCUMENTS

DE 4323905 A1 * 1/1995 ..... B65H 3/0816
EP 762227 A2 * 3/1997 ..... B65H 3/0816

(Continued)

*Primary Examiner* — Luis A Gonzalez
(74) *Attorney, Agent, or Firm* — Oliff PLC

(57) ABSTRACT

A medium feeding device includes a container member that accommodates sheet media, a discharging member disposed further than the media accommodated in the container member in a discharging direction in which the media are discharged, a hand-over member disposed above the container member at a position closer to the discharging member, a floating device disposed on a side of the media accommodated in the container member, and an auxiliary suction member disposed above the container member on a side of the hand-over member opposite to a side closer to the discharging member in the discharging direction in which the media are discharged. The auxiliary suction member is disposed closer to the hand-over member than to an end portion of the media accommodated in the container member opposite to an end portion of the media located closer to the discharging member.

18 Claims, 31 Drawing Sheets

(52) U.S. Cl.
CPC .... *B65H 2406/10* (2013.01); *B65H 2406/363* (2013.01); *B65H 2513/51* (2013.01)

(58) Field of Classification Search
CPC .... B65H 3/48; B65H 3/0883; B65H 2406/34; B65H 2406/342; B65H 2406/3432; B65H 2406/363; B65H 2406/343; B65H 2406/41; B65H 2406/364
See application file for complete search history.

(56) References Cited

U.S. PATENT DOCUMENTS

| | | | | |
|---|---|---|---|---|
| 2017/0060067 | A1* | 3/2017 | Nakamura | B65H 7/00 |
| 2017/0210578 | A1* | 7/2017 | Nakada | B65H 3/08 |

FOREIGN PATENT DOCUMENTS

| | | | |
|---|---|---|---|
| JP | 2003-89435 | A | 3/2003 |
| JP | 2017-95212 | A | 6/2017 |
| JP | 2019-119560 | A | 7/2019 |

* cited by examiner

MEDIUM FEEDING DEVICE AND MEDIUM PROCESSING DEVICE INCLUDING THE SAME

CROSS-REFERENCE TO RELATED APPLICATIONS

This application is based on and claims priority under 35 USC 119 from Japanese Patent Application No. 2022-053794 filed Mar. 29, 2022.

BACKGROUND

(i) Technical Field

The present disclosure relates to a medium feeding device that feeds media such as sheets one by one, and a medium processing device including the same.

(ii) Related Art

For example, devices described in Japanese Unexamined Patent Application Publication No. 2019-119560 (Detailed Description, and FIGS. 3 and 6) and No. 2003-89435 (Embodiment and FIG. 1) are known as this type of medium feeding device.

Japanese Unexamined Patent Application Publication No. 2019-119560 (Detailed Description, and FIGS. 3 and 6) describes a paper feed device that includes a sheet receiving tray that accommodates sheets in a pile, a trailing-end sucking portion that sucks a trailing end of an uppermost sheet on the sheet receiving tray in a sheet feeding direction, and a discharging portion that discharges the sheets in the sheet feeding direction. The trailing-end sucking portion includes a moving portion that is movable in the vertical direction or perpendicular to the sheet surface of the sheets accommodated in the sheet receiving tray, and a second fan that causes a suction force with which the moving portion sucks the sheets. When not sucking any sheet, the moving portion moves downward to come into contact with the uppermost sheet on the sheet receiving tray. When sucking a sheet, the moving portion moves upward to separate the trailing end of the sheet from other sheets.

Japanese Unexamined Patent Application Publication No. 2003-89435 (Embodiment and FIG. 1) describes a paper feed guide mechanism and a paper feed mechanism for a printer. The paper feed guide mechanism includes a sheet feeding tray that receives a large number of printable objects including at least envelopes, and a pair of side plates disposed on the left and right of the sheet feeding tray. The paper feed mechanism includes a restricting guide portion that restricts deviation of the printable objects from a regular position.

SUMMARY

Aspects of non-limiting embodiments of the present disclosure relate to, while performing a method of feeding media by floating and sucking the media one by one, reducing paper feed failures regardless of when the accommodated media are in an inclined position with respect to a discharging direction of the media.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a medium feeding device including a container member that accommodates sheet media, a discharging member disposed further than the media accommodated in the container member in a discharging direction in which the media are discharged, to discharge the media one by one, a hand-over member disposed above the container member at a position closer to the discharging member to suck the media accommodated in the container member with air and pass the media to the discharging member, a floating device disposed on a side of the media accommodated in the container member to blow air to an upper area of a side end surface of the media and float the media while an upper portion of the media is separated, and an auxiliary suction member disposed above the container member on a side of the hand-over member opposite to a side closer to the discharging member in the discharging direction in which the media are discharged, to suck the media accommodated in the container member with air, wherein the auxiliary suction member is disposed closer to the hand-over member than to an end portion of the media accommodated in the container member opposite to an end portion of the media located closer to the discharging member.

BRIEF DESCRIPTION OF THE DRAWINGS

Exemplary embodiments of the present disclosure will be described in detail based on the following figures, wherein:

FIG. 10A illustrates a state where the suction mechanism stops suction, and FIG. 10B illustrates a state where the suction mechanism performs suction;

FIG. 12A is a state where an air outlet of the shutter mechanism is shut, and FIG. 12B is a state where the air outlet of the shutter mechanism is open;

FIG. 14A is a diagram of the auxiliary suction device in an elongated state, FIG. 14B is a diagram of the auxiliary suction device while sucking a medium with air, and FIG. 14C is a diagram of another example of an auxiliary suction device;

DETAILED DESCRIPTION

Summary of Exemplary Embodiments

Figure 1A:
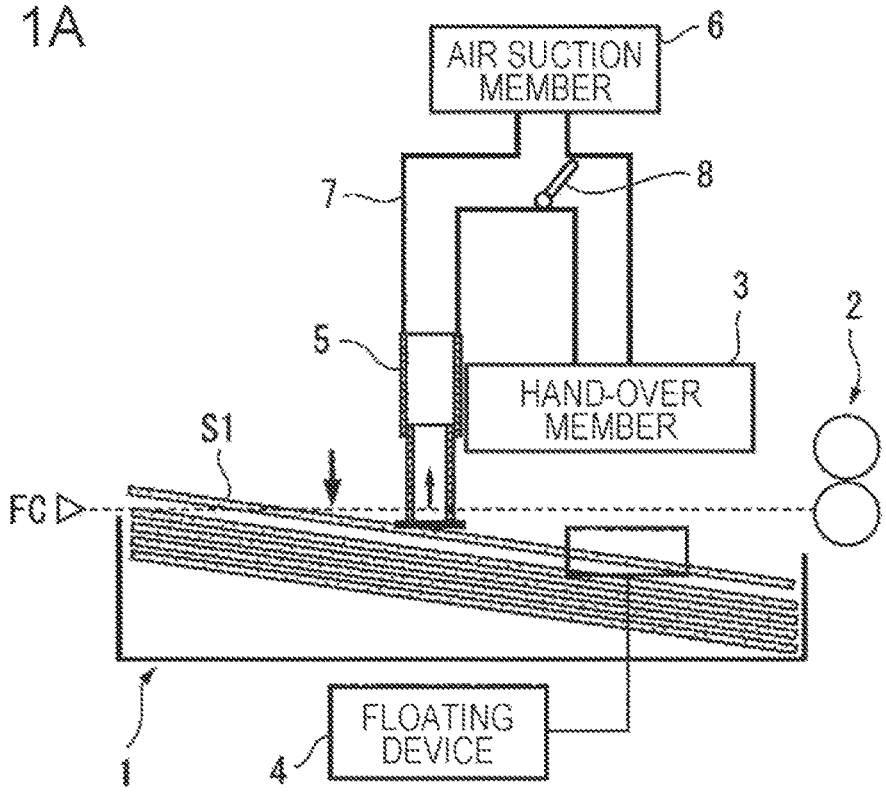
FIG. 1A is a rough schematic diagram of a medium feeding device according to an exemplary embodiment of the present disclosure.

FIG. 1A is a rough diagram of a medium feeding device according to an exemplary embodiment of the present disclosure.

In FIG. 1A, the medium feeding device includes a container member 1 that accommodates sheet media S, a discharging member 2 that is disposed further than the media S accommodated in the container member 1 in a discharging direction in which the media S are discharged to discharge the media S one by one, a hand-over member 3 that is disposed above the container member 1 at a position closer to the discharging member 2 to suck the media S accommodated in the container member 1 with air and pass the media S to the discharging member 2, a floating device 4 that is disposed on a side of the media S accommodated in the container member 1 to blow air to an upper area of a side end surface of the media S and float the media S while an upper portion of the media S is separated, and an auxiliary suction member 5 that is disposed above the container member 1 and on a side of the hand-over member 3 opposite to a side closer to the discharging member in the discharging direction in which the media S are discharged, to suck the media S accommodated in the container member 1 with air, wherein the auxiliary suction member 5 is disposed closer to the hand-over member 3 than to an end portion of the media S accommodated in the container member 1 opposite to an end portion of the media S located closer to the discharging member 2.

The medium feeding device of this type is installed in a medium processing device including a processing member not illustrated that performs a predetermined process on the media S, and used as a device that embodies a function of feeding the media S to the processing member.

In this case, in addition to an image forming member that forms images on the media S, examples of the processing member include a device that performs various processing on media such as forming holes in media, cutting media, sorting media, or folding media.

In such as a technical member, the container member 1 generally includes a mount that receives the media S thereon, and the mount is usually supported by a hoist mechanism to be movable upward and downward. In an aspect of accommodating the media S of various different sizes, the container member 1 includes side guides and a rear guide.

Examples of the discharging member 2 include a wide range of members that discharge media S, and a typical example of the discharging member 2 includes a pair of discharging rollers or a set of a discharging roller and a discharging belt.

Any member, such as a transport shuttle (a vacuum head) or a transport belt, that sucks media one by one, passes the media to the discharging member 2, and returns to the initial position may be appropriately selected as the hand-over member 3.

Any member that blows air to the upper area of the accommodated media S from a side of the container member 1 (including the front or rear side in a medium discharging direction besides a side in a width direction crossing the medium discharging direction) may be selected as the floating device 4.

The auxiliary suction member 5 may be disposed at any position on a side of the hand-over member 3 opposite to the side closer to the discharging member in the discharging direction in which the media S are discharged, and may have one or more air suction ports.

Particularly, in the present example, the auxiliary suction member 5 is to be disposed closer to the hand-over member 3 than to an end portion of the media S accommodated in the container member 1 opposite to an end portion of the media S located closer to the discharging member 2.

In this case, "being located closer to the hand-over member 3" indicates being located immediately close regardless of being in contact or not in contact with the hand-over member 3. Thus, in an operation of passing the media S to the hand-over member 3, the auxiliary suction member 5 may be fixed while being separated from the hand-over member 3 or may move together with the hand-over member 3. In an aspect where the auxiliary suction member 5 is disposed while being not in contact with the hand-over member 3, the auxiliary suction member 5 may be located closer to the hand-over member 3 than to an end portion of the media S accommodated in the container member 1 opposite to an end portion of the media S located closer to the discharging member 2.

When the auxiliary suction member 5 is thus disposed closer to the hand-over member 3, regardless of when the media S accommodated in the container member 1 are in the inclined position, the inclination of the media S between the auxiliary suction member 5 and the hand-over member 3 that are located close to each other is reduced when the auxiliary suction member 5 performs auxiliary suction of the media S (specifically, an uppermost medium S1). This structure is effective for the hand-over member 3 to stabilize air suction of the media S.

Although the air suction force of the auxiliary suction member 5 may be selected as appropriate, the air suction force is to be sufficient for assisting the hand-over member 3 in performing the medium air-suction operation.

Typical or preferable aspects of a medium feeding device according to the present embodiment will be described now.

First, as a typical aspect of the auxiliary suction member 5, as illustrated in FIG. 1A, the auxiliary suction member 5 sucks with air the media S (more specifically, S1) accommodated in the container member 1 earlier than the hand-over member 3 performs air suction. In this example, the auxiliary suction member 5 performs air suction on the media S and holds the media S earlier than the hand-over member 3 does, and thus the media S are brought closer to the hand-over member 3. This structure accordingly facilitates the hand-over member 3 to perform air suction of the media S, and is thus preferable.

As illustrated in FIG. 1A, as another typical aspect of the auxiliary suction member 5, when the position where the hand-over member 3 is capable of performing an air-suction operation on the uppermost medium S1 is defined as a medium reference height FC on condition that the media S with a substantially uniform thickness are accommodated in the container member 1 in a substantially horizontal position, the auxiliary suction member 5 sucks with air the media S at a position lower than the medium reference height FC. In this example, when, for example, the media S in the container member 1 is inclined in the accommodated position and when the uppermost medium S1 of the media S facing the suction surface of the hand-over member 3 is located lower than the medium reference height FC, the uppermost medium S1 floated by the hand-over member 3 may fail to be sucked with air regardless of when the upper portion of the media S is separated and floated by the floating device 4. However, in this example, the auxiliary suction member 5 located close to the hand-over member 3 sucks with air the medium S1 located lower than the medium reference height FC. Thus, the auxiliary suction member 5 raising the medium S1 to near the medium reference height FC effectively assists the hand-over member 3 in air suction of the medium S1.

Another preferable aspect of the auxiliary suction member 5 starts the air-suction operation before the hand-over member 3 performs the air-suction operation. For example, in a first aspect, when the auxiliary suction member 5 starts the air-suction operation at this manner, the auxiliary suction member 5 performs air suction of the media S earlier than the hand-over member 3 does. In second and third aspects, the timing when the auxiliary suction member 5 starts the air-suction operation includes the same timing as when the hand-over member 3 starts the air-suction operation. However, when the auxiliary suction member 5 performs the air-suction operation earlier than the hand-over member 3, the auxiliary suction member 5 sucks the media S with air to hold the media S when the hand-over member 3 is to suck the media S with air. This performance is preferable in that it facilitates the air suction of the media S performed by the hand-over member 3.

As a typical aspect of the timing of the air-suction operation performed by the auxiliary suction member 5, the auxiliary suction member 5 starts the air-suction operation earlier than the hand-over member 3, and finishes the air-suction operation after the hand-over member 3 starts the air-suction operation. In this example, the auxiliary suction member 5 may finish the air-suction operation on the media S at the same timing as when the hand-over member 3 starts the air-suction operation. In this case, the media S sucked with air by the auxiliary suction member 5 is handed over to the hand-over member 3 and sucked with air by the handover member 3. In view of a smooth handover of the air-suction operation from the auxiliary suction member 5 to the hand-over member 3, preferably, the auxiliary suction member 5 starts the air-suction operation earlier than the hand-over member 3, and finishes the air-suction operation after the hand-over member 3 starts the air-suction operation, so that the air-suction operation is performed by both the auxiliary suction member 5 and the hand-over member 3 for a predetermined period while being handed over from the auxiliary suction member 5 to the hand-over member 3.

Figure 1B:
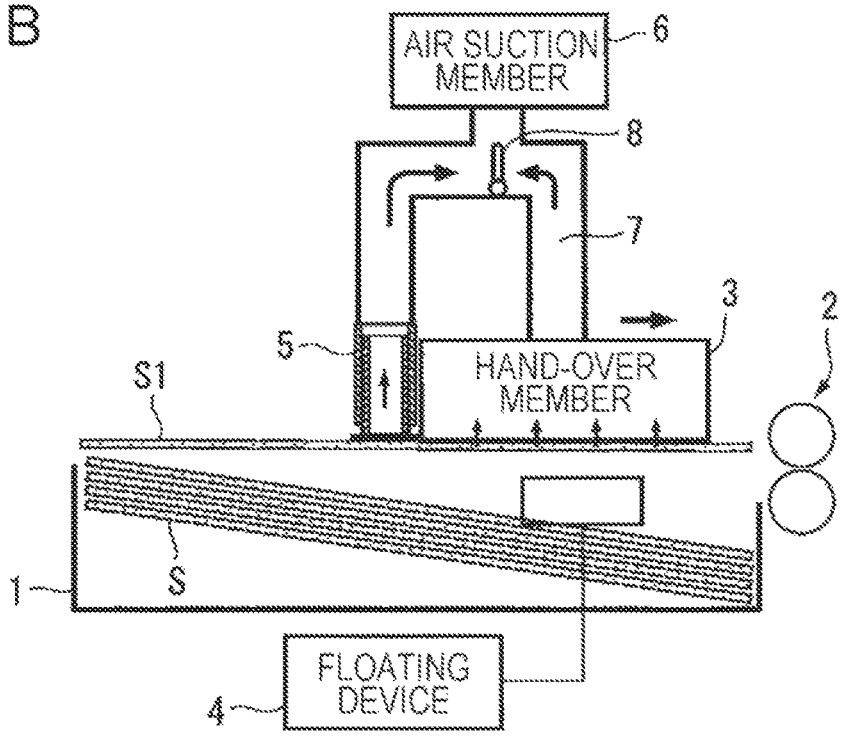
FIG. 1B is a diagram illustrating an operation of the medium feeding device in FIG. 1A.

As a typical aspect of the auxiliary suction member 5 that performs the air-suction operation, as illustrated in FIGS. 1A and 1B, the auxiliary suction member 5 is continuous to an air suction member 6 through a flow-path forming portion 7, and an opening-degree adjusting member 8 that opens or shuts the flow path formed from the flow-path forming portion 7 is disposed in the flow-path forming portion 7.

Figure 32:
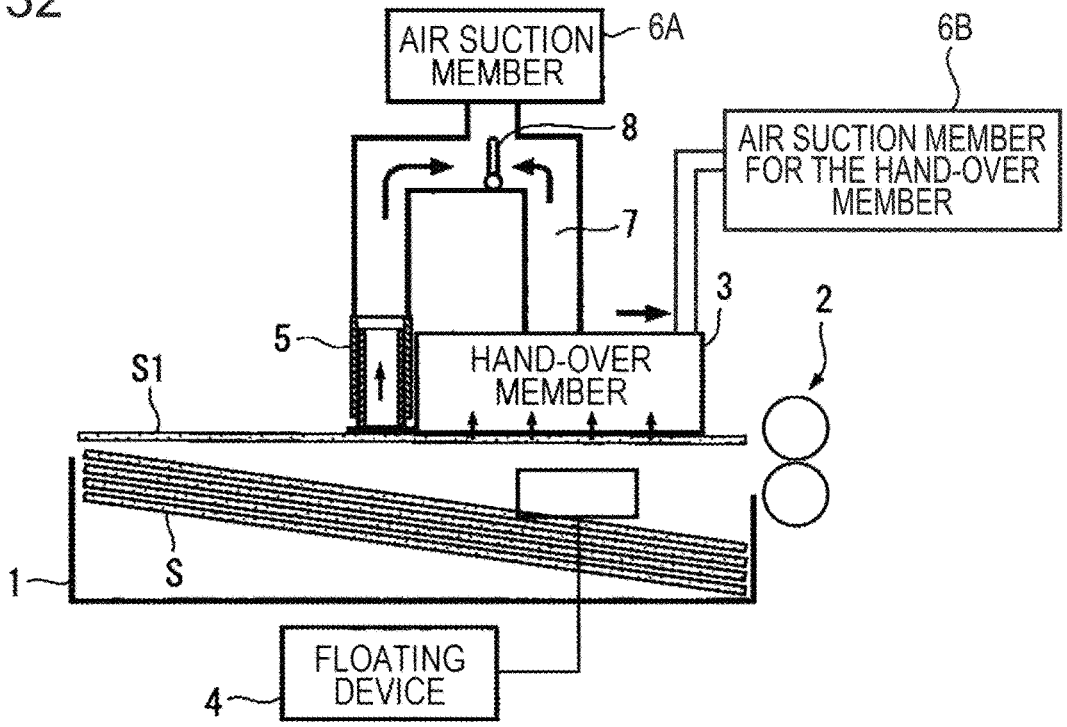
FIG. 32 illustrates how the air suction member shown in FIG. 1B is provided separately from an air suction member for the hand-over member to perform an air-suction operation.

In this example, the air suction member 6 may be provided separately from the air suction member used by the hand-over member 3 for the air-suction operation, or may be used in common with the air suction member used by the hand-over member 3 for the air-suction operation. FIG. 32 shows an exemplary embodiment of a configuration whereby the air suction member 6A is provided separately from the air suction member 6B used by the hand-over member 3 for the air-suction operation.

In this case, as a typical aspect of the air suction member 6 for common use, for example, the flow-path forming portion 7 includes a first flow-path forming portion that connects the air suction member 6 and the hand-over member 3 to each other, and a second flow-path forming portion that diverges from the first flow-path forming portion to be connected to the auxiliary suction member 5. The opening-degree adjusting member 8 includes a first opening-degree adjusting portion that is disposed at a portion of the first flow-path forming portion closer to the hand-over member 3 than a diverging portion leading to the second flow-path forming portion to adjust the degree of opening, and a second opening-degree adjusting portion that is disposed at the second flow-path forming portion to adjust the degree of opening (refer to a third exemplary embodiment).

As another typical aspect of the air suction member 6 for common use, the flow-path forming portion 7 includes a first flow-path forming portion that connects the air suction member 6 and the hand-over member 3 to each other, and a second flow-path forming portion that diverges from the first flow-path forming portion to be connected to the auxiliary suction member 5, and the opening-degree adjusting member 8 includes a common-use opening-degree adjusting portion that is disposed at the diverging portion between the first flow-path forming portion and the second flow-path forming portion to divide the suction air among the auxiliary suction member 5 and the hand-over member 3 (refer to modification examples 3-1 to 3-3).

As a typical control method of the air-suction operation performed by the auxiliary suction member 5, the auxiliary suction member 5 starts the air-suction operation after the opening-degree adjusting member 8 switches to a first opening-degree mode that enables only the air-suction operation performed by the auxiliary suction member 5, and the hand-over member 3 starts the air-suction operation after a specific time period has passed from when the auxiliary suction member 5 starts the air-suction operation after the opening-degree adjusting member 8 switches to a second opening-degree mode that enables the air-suction operation performed by the hand-over member 3 in addition to the air-suction operation performed by the auxiliary suction member 5.

As a typical aspect of the auxiliary suction member 5, the auxiliary suction member 5 includes a moving duct having a lower end portion vertically movable, and the auxiliary suction member 5 moves the moving duct to a predetermined lower target position, and starts the air-suction operation.

Preferably, the target position is located lower than the medium reference height FC. For example, assume a case where the media S accommodated in the container member 1 have a thickness that varies between the opening and the bottom such as envelopes. In this case, when the media S formed from the envelopes are piled and accommodated in the container member 1, as illustrated in FIG. 1A, the media S may be inclined in the container member 1.

In this state, when the uppermost one of the media S is denoted with S1, the lower portion of the medium S1 in the inclined position is located lower than the medium reference height FC. Particularly, when the portion of the medium S1 in the inclined position lower than the medium reference height FC faces the hand-over member 3, regardless of when the uppermost medium S1 is floated by the floating device 4, the lower portion of the medium S1 in the inclined position may fail to arrive at the medium reference height FC. For example, when only the hand-over member 3 performs the air-suction operation, the medium S1 may be unstably sucked with air.

In such a state, in the present exemplary embodiment, the auxiliary suction member 5 is disposed close to the hand-over member 3 on the side opposite to the side closer to the discharging member 2 in the discharging direction in which the media S are discharged. Regardless of when the uppermost medium S1 is disposed in an inclined position while having a portion closer to the hand-over member 3 lowered, the portion of the inclined medium S1 facing the auxiliary suction member 5 is located higher than the portion of the inclined medium S1 facing the hand-over member 3. Thus, the distance between the auxiliary suction member 5 and the medium S1 is shorter than the distance between the hand-over member 3 and the medium S1, and accordingly, the auxiliary suction member 5 sucks the medium S1 with air and holds the medium S1 earlier than the hand-over member 3 does, and assists the hand-over member 3 in air suction of the medium S1.

As a preferable aspect of the auxiliary suction member 5 including a moving duct, the auxiliary suction member 5 includes a vertically expandable moving duct, extends the moving duct to a target position under its own weight, and starts the air-suction operation.

As another aspect, the auxiliary suction member 5 includes a vertically movable moving duct and a driving member that vertically moves the moving duct, moves the moving duct to a target position, and starts the air-suction operation.

As another preferable aspect of the auxiliary suction member 5, the auxiliary suction member 5 includes a moving duct with a lower end portion vertically movable, and the moving duct includes an absorber that absorbs an excess of movement of the lower end portion. In this example, examples of the absorber include an elastic spring and an expandable divided duct structure. Addition of such an absorber prevents the medium S1 from being damaged regardless of when the medium S1 is hardly hit by the auxiliary suction member 5, and is thus effective to stably perform the air-suction operation.

Although the air suction area of the auxiliary suction member 5 is not appropriately selected, to provide a simple structure, the air suction area may be smaller than the air suction area of the hand-over member 3.

The auxiliary suction member 5 may preferably be installed at a substantially center of the media S in the width direction crossing the discharging direction in which the media S are discharged when, for example, the media S are accommodated while being deformed in a recessed shape along the width.

First Exemplary Embodiment

Hereinbelow, the present disclosure will be further described in detail based on exemplary embodiments illustrated in appended drawings.

Figure 2:
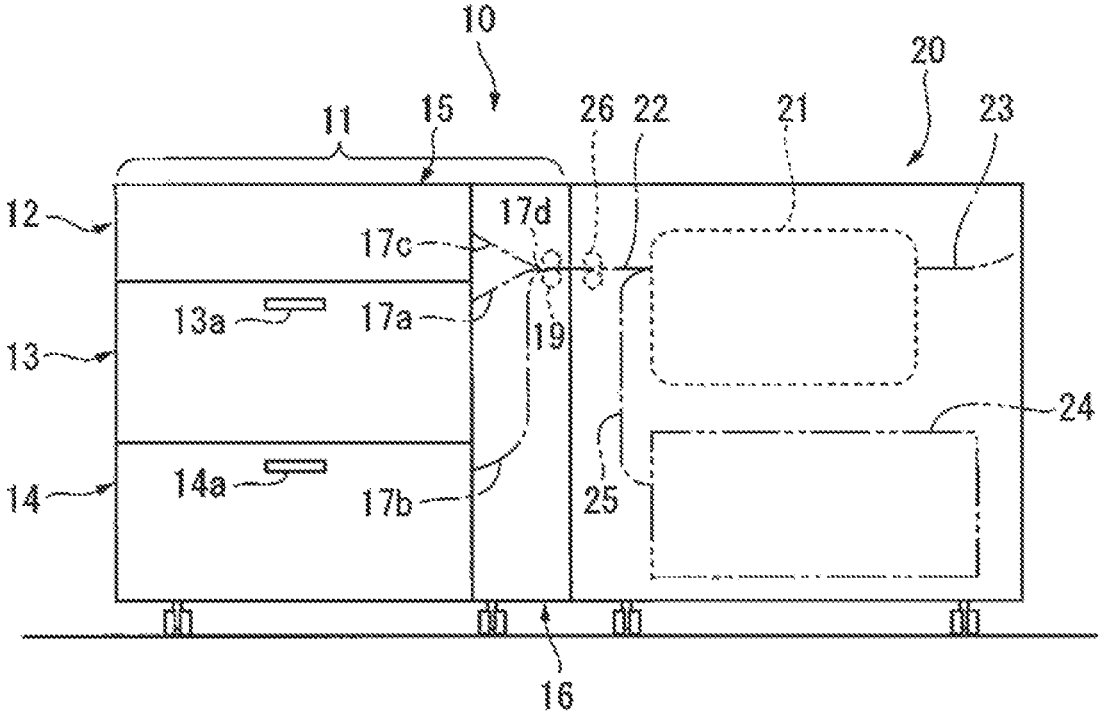
FIG. 2 is a diagram of the entire structure of a medium processing device according to a first exemplary embodiment.

FIG. 2 is a diagram of the entire structure of a medium processing device according to a first exemplary embodiment.

Entire Structure of Medium Processing Device

In FIG. 2, a medium processing device 10 includes a medium feeding device 11 that feeds sheet media one by one, and a processing unit 20 that serves as a processing member that performs a predetermined process on the media fed from the medium feeding device 11.

In the present example, the processing unit 20 includes an image forming unit 21 that forms images on the media. The image forming unit 21 employs various image forming methods such as an electrophotographic system or an inkjet printing method. The processing unit 20 includes an importing path 22 along which media fed from the medium feeding device 11 are transported to the image forming unit 21, and an exporting path 23 along which media undergoing image formation at the image forming unit 21 are transported out of the processing unit 20. In this example, the processing unit 20 separately includes a built-in medium feeder 24 below the image forming unit 21. Media from the medium feeder 24 are also fed to the image forming unit 21 through a feed transport path 25. Importing rollers 26 are disposed at the entrance of the importing path 22. An appropriate number of transporting members are disposed at the importing path 22, the exporting path 23, and the feed transport path 25.

Entire Structure of Medium Feeding Device

Figure 3:
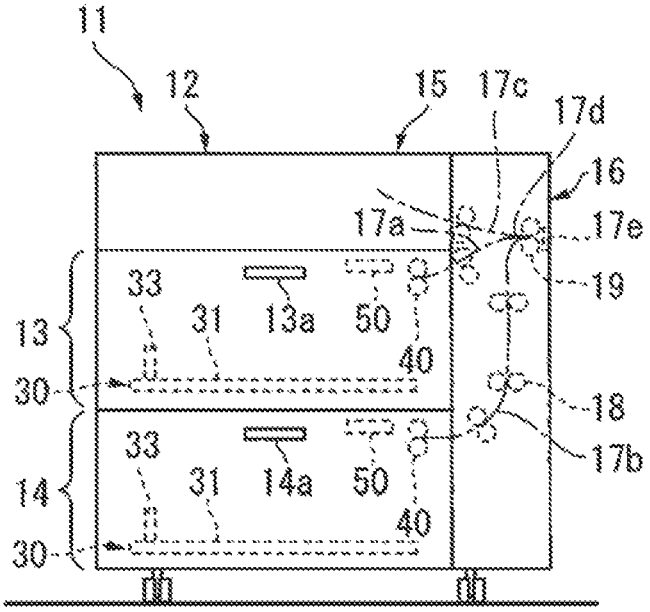
FIG. 3 is diagram of a medium feeding device included in the medium processing device according to the first exemplary embodiment.

In this example, as illustrated in FIG. 2 and FIG. 3, the medium feeding device 11 includes a housing 12 that accommodates media. The housing 12 includes an upper drawer 13 and a lower drawer 14 vertically arranged in two stages to be drawable outward, and a manual feeder 15 disposed at an upper portion of the housing 12 to allow media to be manually fed therethrough. The medium feeding device 11 also includes a relay unit 16 on the side of the housing 12 closer to the processing unit 20. The relay unit 16 relays media fed from the upper drawer 13, the lower drawer 14, and the manual feeder 15 to transport the media to the processing unit 20.

In this example, both the upper drawer 13 and the lower drawer 14 accommodate a large number of media and feed the media one by one. The relay unit 16 includes a first transport path 17*a* along which the media fed from the upper drawer 13 are transported, a second transport path 17*b* along which the media fed from the lower drawer 14 are transported, and a third transport path 17*c* along which the media fed from the manual feeder 15 are transported. An appropriate number of transport rollers 18 are disposed at the first to third transport paths 17*a* to 17*c*. A merging transport path 17*d* that is continuous with an outlet port 17*e* leading to the processing unit 20 is disposed at the exit side of each of the first to third transport paths 17*a* to 17*c*. Discharge rollers 19 are disposed at the merging transport path 17*d*. The upper drawer 13 and the lower drawer 14 respectively include pulls 13*a* and 14*a* to be drawable to the near side.

Structure Example of Upper Drawer (Lower Drawer)

In this example, the upper drawer 13 and the lower drawer 14 have substantially the same structure. Hereinbelow, the upper drawer 13 is described as an example.

Figure 4:
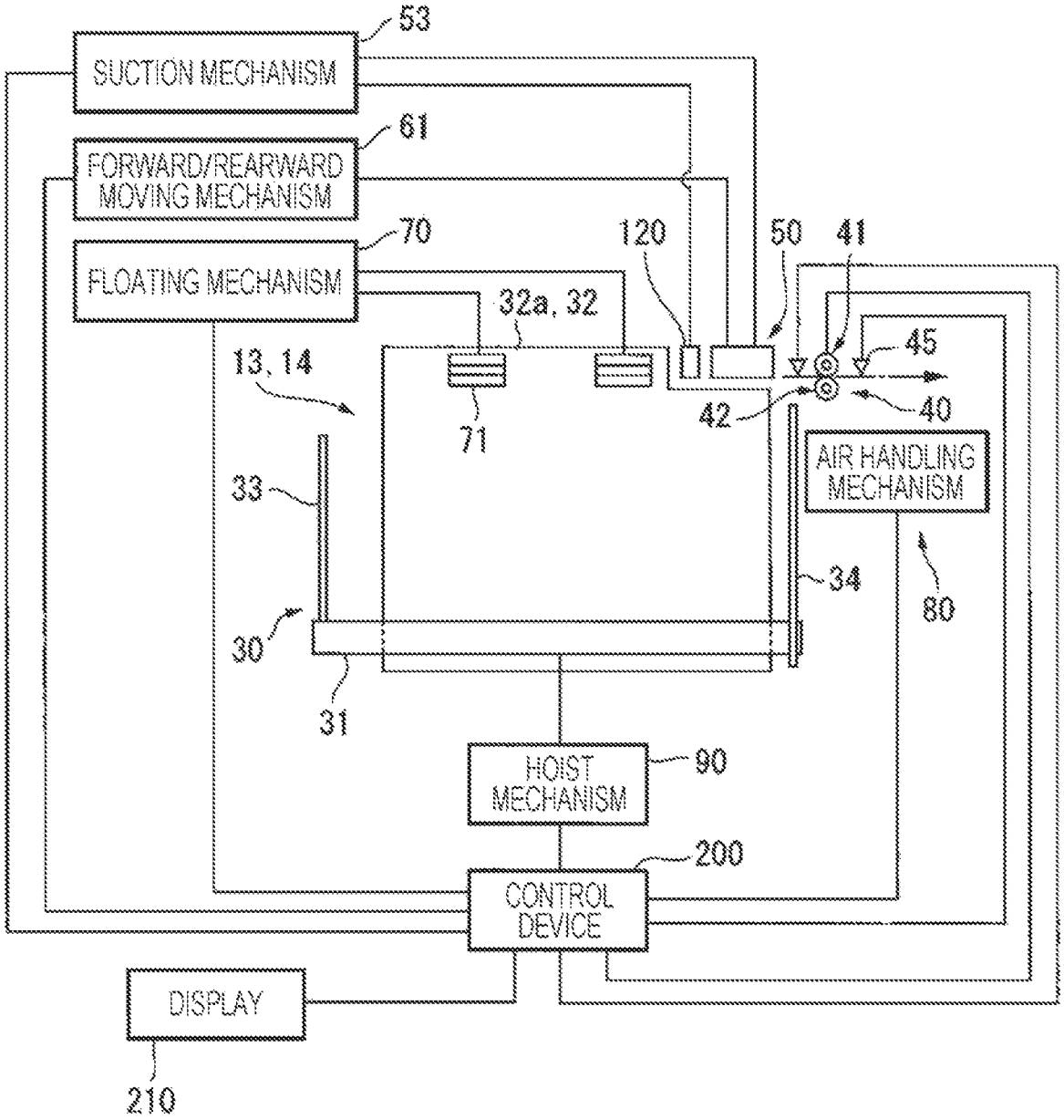
FIG. 4 is a diagram of a drive control system in the medium feeding device according to the first exemplary embodiment.

In this example, as illustrated in, for example, FIG. 4, the upper drawer 13 includes a container 30 serving as a container member that accommodates sheet media, discharging rollers 40 serving as a discharging member disposed further than the media accommodated in the container 30 in a discharging direction in which the media are discharged to discharge the media one by one, a vacuum head 50 disposed above the container 30 to serve as a hand-over member that sucks the media accommodated in the container 30 with air and passes the media to the discharging rollers 40, a floating mechanism 70 that is disposed on a side of the media accommodated in the container 30 in a direction crossing the discharging direction in which the media is discharged, the floating mechanism 70 serving as a floating device that blows air to the side of the media to float the media while separating the upper area of the media, and an air handling mechanism 80 disposed further than the media accommodated in the container 30 in a discharging direction in which the media are discharged, the air handling mechanism 80 blowing air to separate an upper medium floated by the floating mechanism 70 from a medium located below the upper media.

Container

Figure 5:
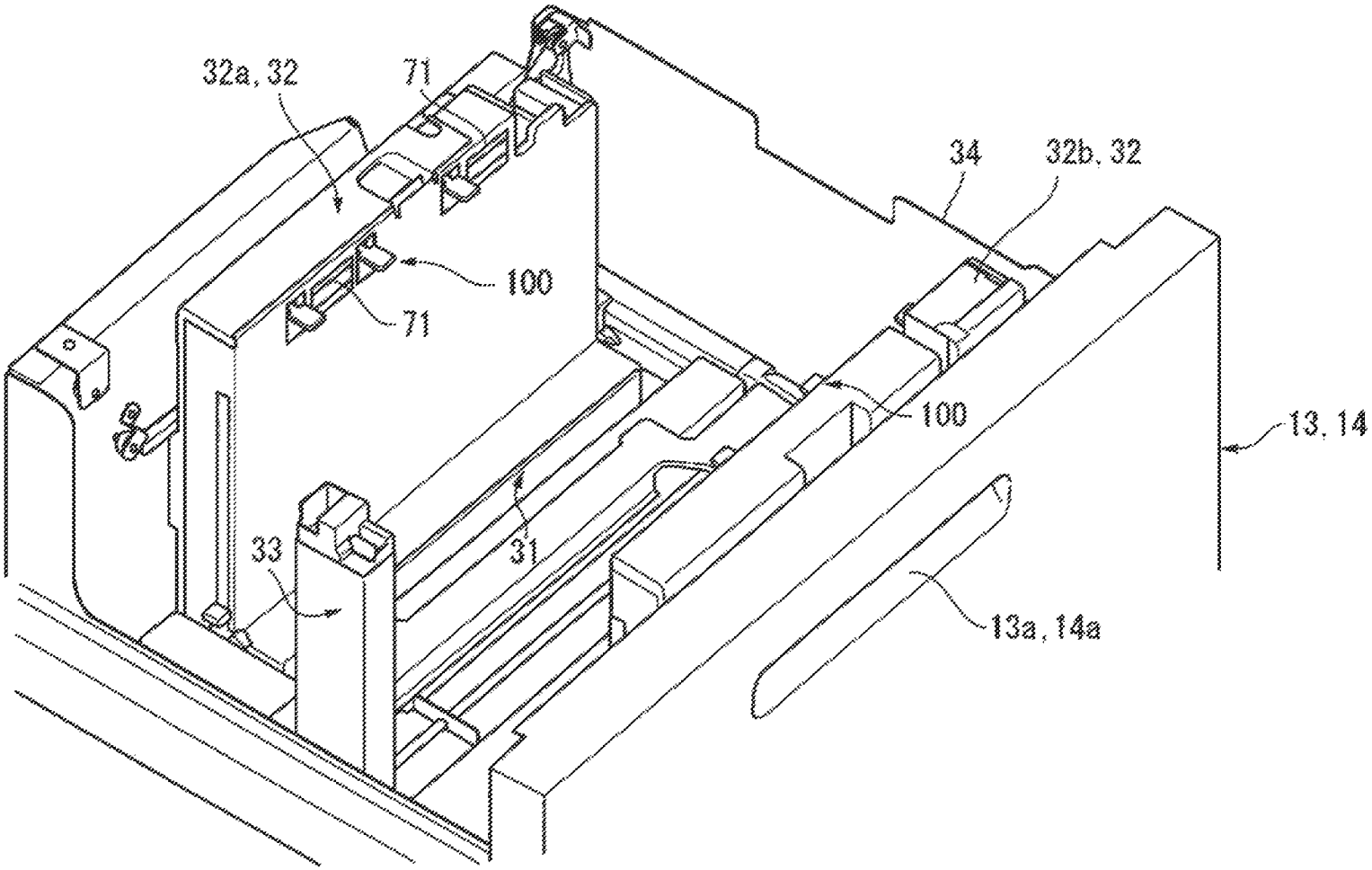
FIG. 5 is a perspective view of a medium container in the medium feeding device according to the first exemplary embodiment.

In this example, as illustrated in FIG. 4 and FIG. 5, the container 30 includes a receiving bottom plate 31 that receives media of various sizes, side guides 32 (more specifically, 32*a* and 32*b*) disposed on the sides, in a width direction crossing the discharging direction, of media of various sizes placed on the receiving bottom plate 31 to serve as side guide members that fix and guide the side position of the media, an end guide 33 disposed at a rear side opposite to the side closer to the discharging member in the discharging direction in which the media loaded on the receiving bottom plate 31 are discharged to serve as a rear guide member that fixes and guides the rear position of the media, and a partitioning plate 34 that defines the position of the media loaded on the receiving bottom plate 31 in the discharging direction in which the media are discharged.

In this example, the container 30 may be designed in accordance with the size of media to be used. However, in view of high versatility, preferably, a normal-size medium is to be mainly used. In this case, examples of the normal-size medium include media with a longitudinal dimension up to 488 mm. An example of media with such a size corresponds to media of A3 size or smaller in Japanese Industrial Standards (JIS).

In this example, examples of medium include, in addition to media with a uniform thickness, a medium with an uneven thickness such as an envelope that varies in thickness in the discharging direction.

In this example, the side guides 32 are movable in the width direction of the receiving bottom plate 31, and fixed in a predetermined fixed position. The end guide 33 is movable in the discharging direction of the media on the receiving bottom plate 31, and fixed in a predetermined fixed position. In this example, a separation plate 35 (refer to FIG. 7) protrudes upward from the upper edge of the partitioning plate 34. The separation plate 35 serves as a stopper wall that stops the upper area of a pile of the media located below the medium sucked by the vacuum head 50 with air.

<Hoist Mechanism>

As illustrated in FIG. 4, the receiving bottom plate 31 is supported by a hoist mechanism 90 described below (refer to FIGS. 6A and 6B) to be movable upward and downward.

Figure 6A:
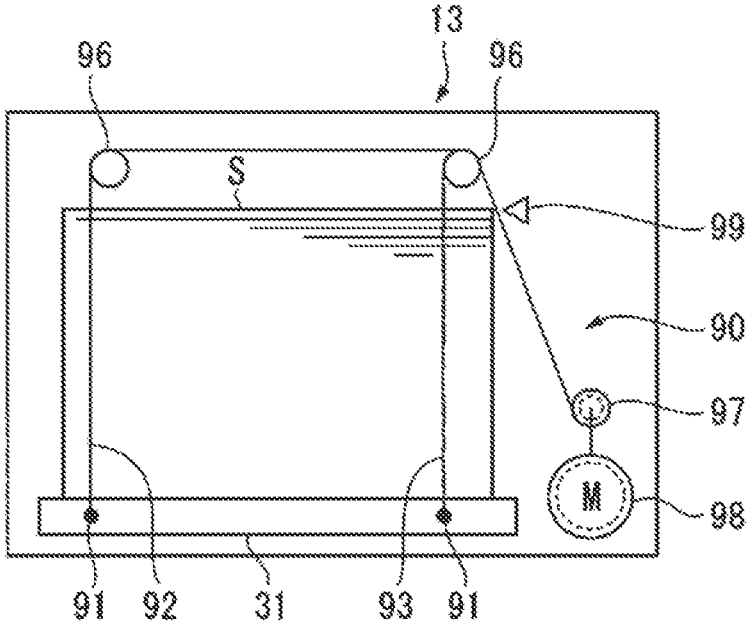
FIG. 6A is a diagram of a hoist mechanism illustrated in FIG. 4.
Figure 6B:
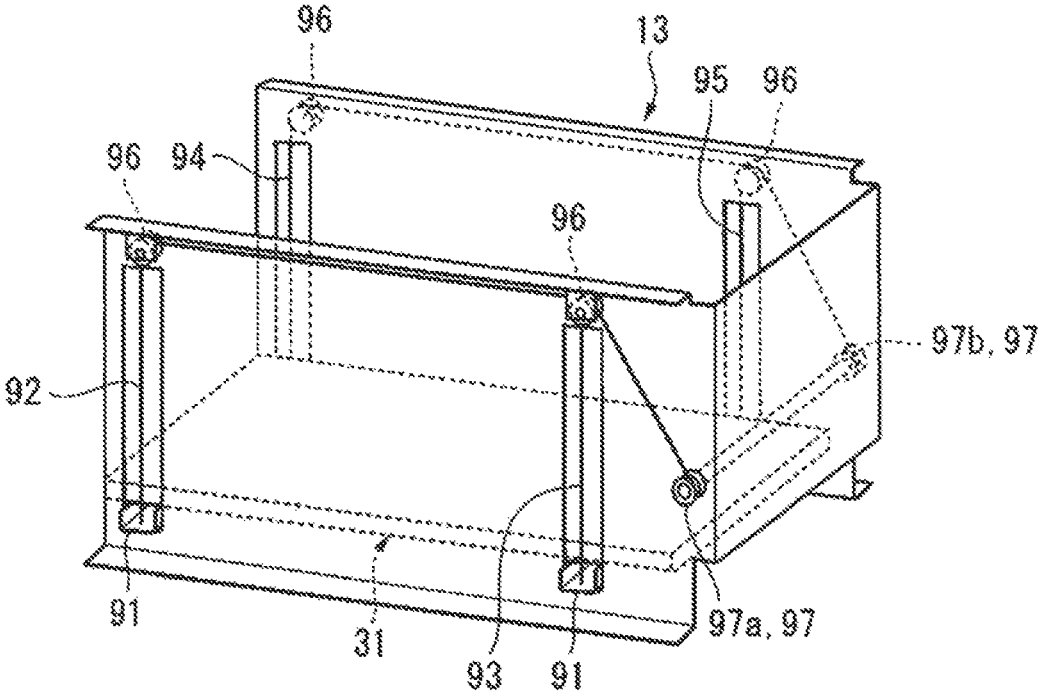
FIG. 6B is a perspective view of a related portion of the hoist mechanism illustrated in FIG. 6A.

In this example, as illustrated in FIGS. 4, 6A, and 6B, the hoist mechanism 90 includes suspension portions 91 disposed at four portions of the receiving bottom plate 31 at both sides in the width direction crossing the medium discharging direction, and four wires 92 to 95 having the far ends coupled to the respective suspension portions 91. After each of the wires 92 to 95 is wound around one or more guide pulleys 96, a first end of each of the wires 92 to 95 is stuck to coaxially coupled take-up pulleys 97 (97*a* and 97*b* in this example), the take-up pulleys 97 are rotated by a driving motor 98 that is rotatable forward and backward, and the wires 92 to 95 are moved by a predetermined amount to raise or lower the receiving bottom plate 31 while keeping the receiving bottom plate 31 in a horizontal position.

Figure 18A:
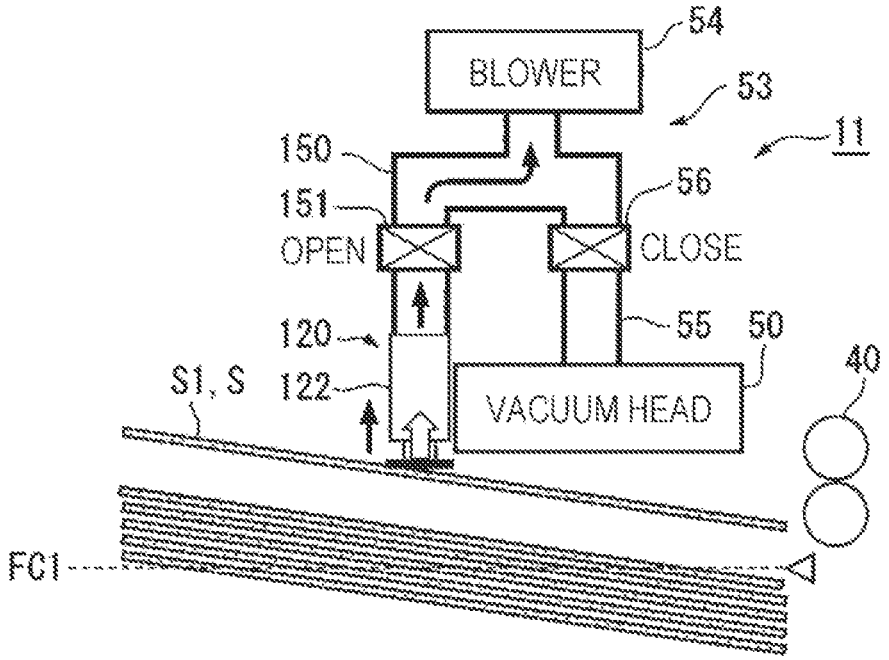
FIG. 18A is a diagram of the procedure of a medium air-suction operation performed by the auxiliary suction device.

A height sensor 99 sets the surface of one of the media loaded on the receiving bottom plate 31 to the predetermined medium reference height FC (refer to FIG. 18A).

The medium reference height FC in this case refers to a position where the uppermost position of the medium is set for the vacuum head 50 to be capable of performing an air-suction operation on the media on condition that the media S with a uniform thickness such as normal paper sheets are accommodated in the container 30 in a substantially horizontal position.

Pay-Out Roller

Figure 7:
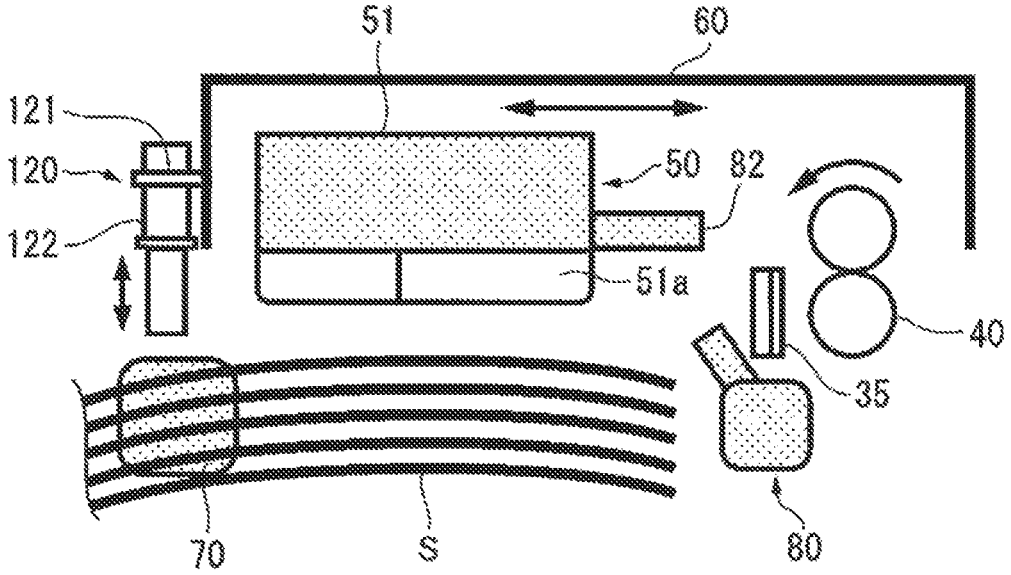
FIG. 7 is a diagram of a related portion of the medium feeding device according to the first exemplary embodiment.

In this example, as illustrated in FIG. 4 and FIG. 7, the discharging rollers 40 include a driving roller 41 that drives to rotate, and a driven roller 42 that is driven to rotate following the rotation of the driving roller 41. The discharging rollers 40 transport a medium while holding the medium at a contact portion between the driving roller 41 and the driven roller 42.

Position Sensor

In the present exemplary embodiment, as illustrated in FIG. 4, a position sensor 45 is disposed downstream from the discharging rollers 40 in the medium discharging direction. This position sensor 45 detects the passage of a medium through a nip area of the discharging rollers 40, and is disposed in a medium passage area. A detection signal from the position sensor 45 notifies the end of the operation of feeding a medium S transported previously, and serves as a trigger of the operation of feeding the subsequent medium S in a successive feeding mode.

Vacuum Head

Figure 8:
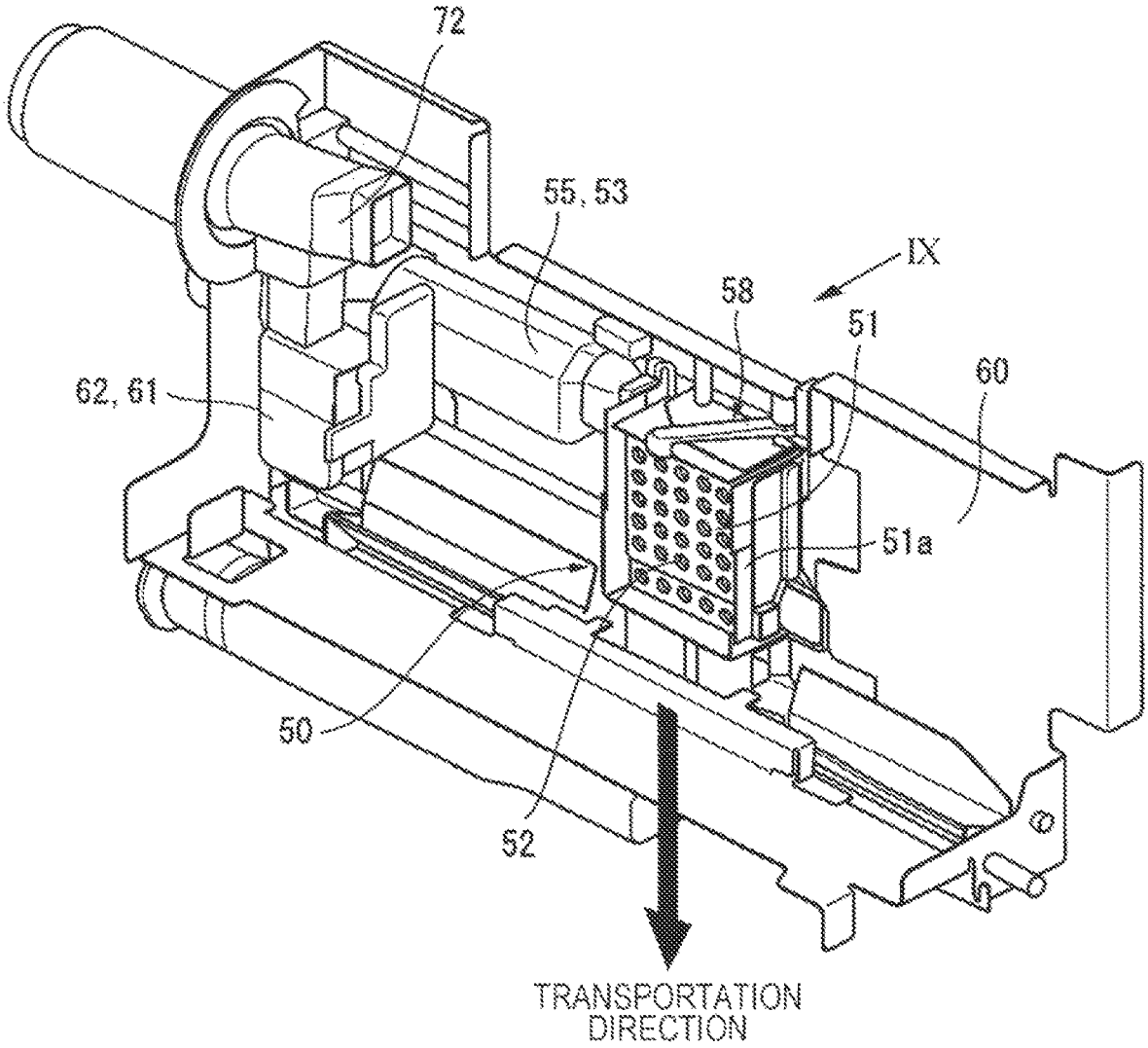
FIG. 8 is a detailed diagram of a vacuum head serving as a hand-over member according to the first exemplary embodiment.

In this example, as illustrated in FIGS. 4, 7, and 8, the vacuum head 50 is supported with a guide mechanism 58 (for example, a guide rod) by a head frame 60 fixed to the housing 12 above the container 30 to be movable forward and rearward in the medium discharging direction.

In this example, the vacuum head 50 includes a hollow box-shaped head body 51. A surface of the head body 51 facing the media accommodated in the container 30 has a large number of vacuum holes 52. The vacuum head 50 also includes a skirt portion 51*a* around the vacuum holes 52 in the head body 51 to keep the medium hermetic while sucking the medium with air.

Figure 10A:
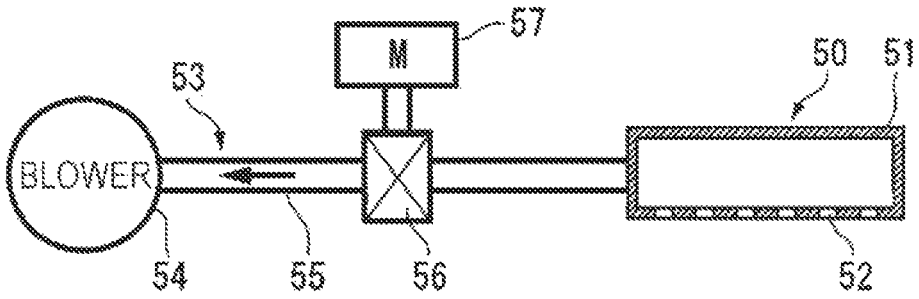
FIGS. 10A and 10B are diagrams of a suction mechanism in the vacuum head, where
Figure 10B:
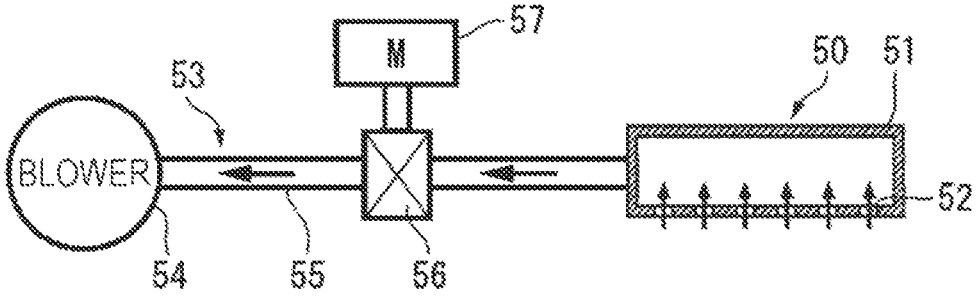

A suction mechanism 53 is connected to the head body 51. As illustrated in FIGS. 10A and 10B, in this case, an example used as the suction mechanism 53 has a structure where a suction blower 54 and the head body 51 are connected with a connection duct 55, an open-close valve 56 that opens and shuts the path is disposed at a portion of the connection duct 55, and the open-close valve 56 is opened or shut by a valve motor 57.

Figure 9:
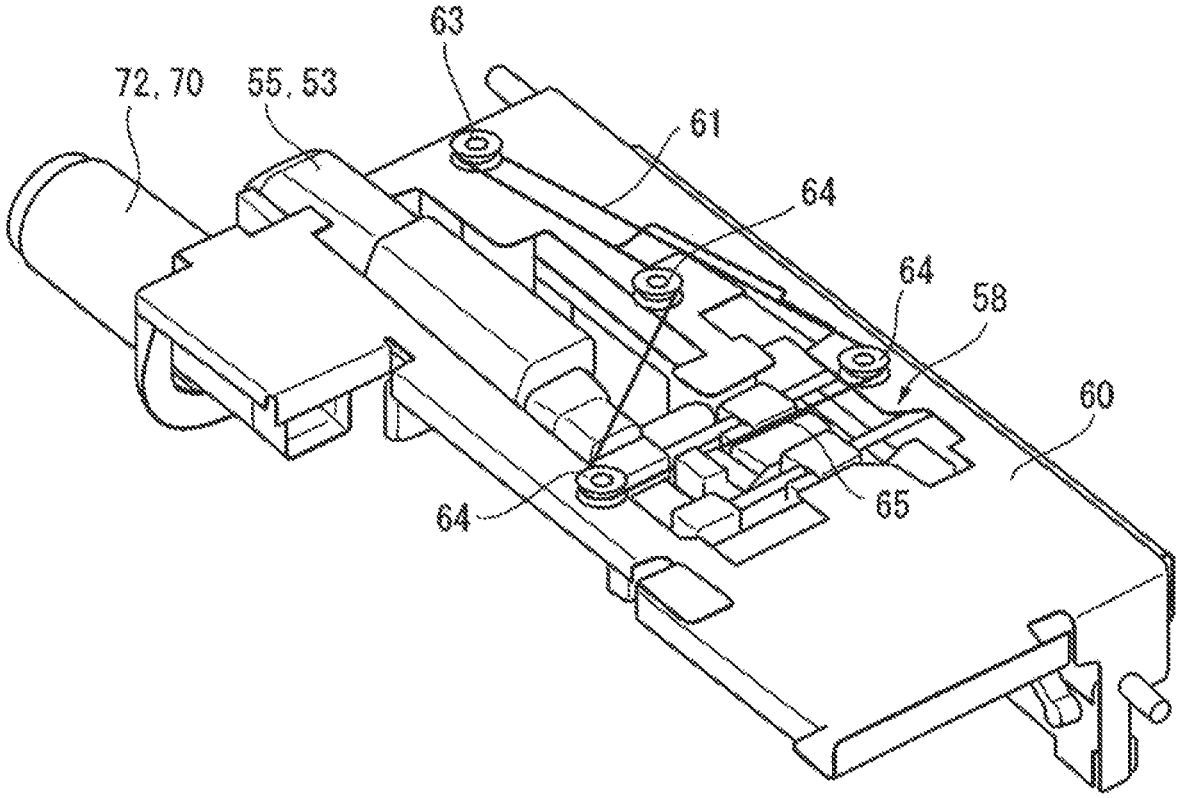
FIG. 9 is a diagram of a forward/rearward moving mechanism of the vacuum head viewed in a direction IX in FIG. 8.

A forward/rearward moving mechanism 61 that moves the vacuum head 50 forward and rearward is disposed at the head frame 60. In this example, as illustrated in FIG. 8 and FIG. 9, the forward/rearward moving mechanism 61 fixes a stepping motor 62 to the head frame 60, a driving pulley 63 is coupled to the stepping motor 62, a predetermined number of transmission pulleys 64 are disposed at the head frame 60 at appropriate positions, a wire 65 is wound around the driving pulley 63 and the transmission pulleys 64, and part of the wire 65 is stuck to the vacuum head 50. In this example, the driving pulley 63 rotates in response to the forward or rearward rotation of the stepping motor 62, the wire 65 moves by a predetermined distance in response, and the vacuum head 50 moves forward or rearward in the medium discharging direction.

Floating Mechanism

In this example, as illustrated in FIGS. 4, 5, 7, and 11, the floating mechanism 70 includes, for example, hollow box-shaped side guides 32 (32*a* and 32*b*). Each side guide 32 has multiple air outlets 71 at an upper portion facing the side of the media, and has, in the hollow portion, an air duct 72 having one end continuous with the corresponding air outlet 71 and the other end continuous with a blower 73 for blowing air. In this case, the blower 73 may be installed inside each side guide 32 or disposed outside of the side guide 32.

In this example, medium restrictors 100 are disposed near the air outlets 71 of the side guide 32. The medium restrictors 100 in this example are disposed on the side of the media loaded on the receiving bottom plate 31, and protrude to a medium accommodation area to restrict floating excess of media that float while using the floating mechanism 70.

Figure 11:
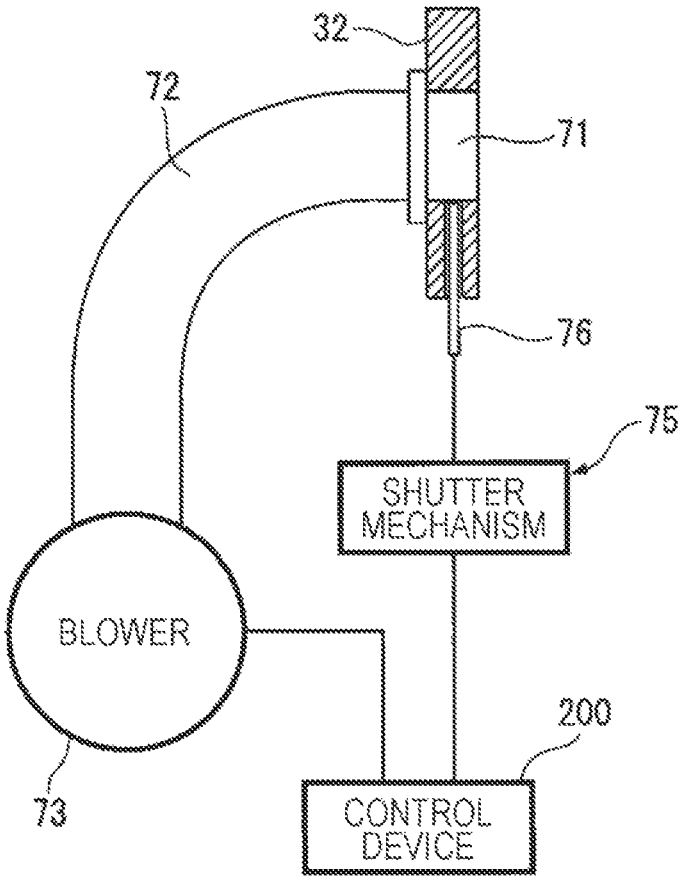
FIG. 11 is a diagram of a floating mechanism illustrated in FIG. 4.
Figure 12B:
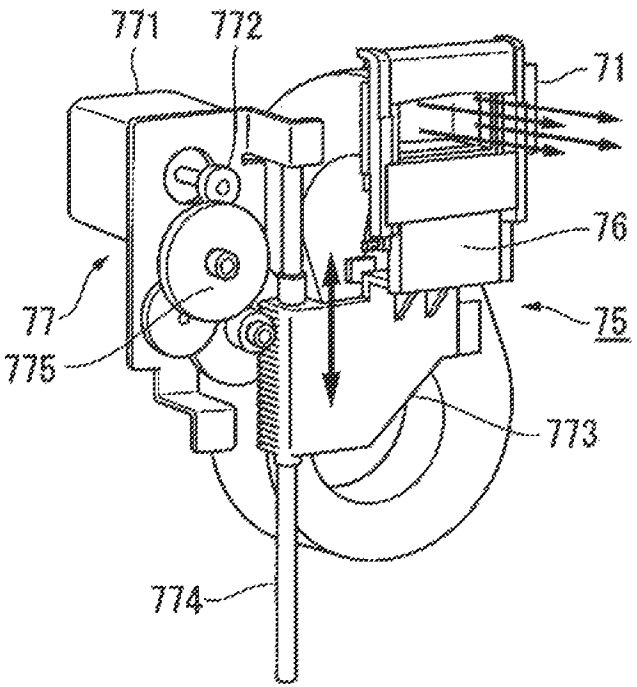
FIGS. 12A and 12B are diagrams of a shutter mechanism included in the floating mechanism, where
Figure 12A:
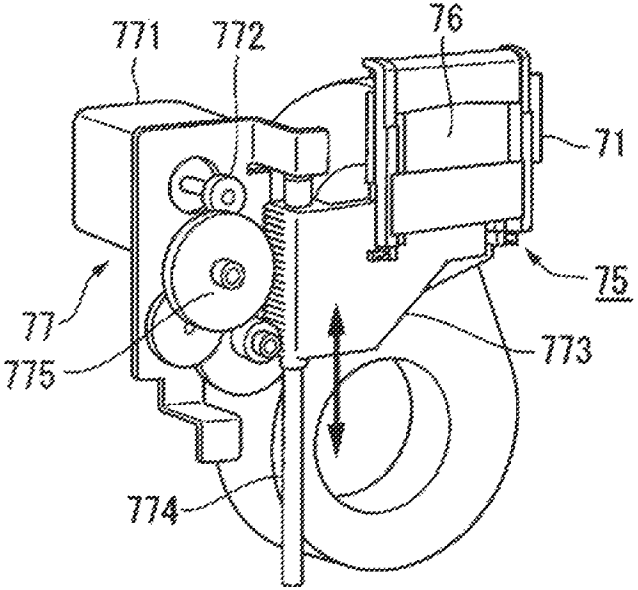
Figure 13A:
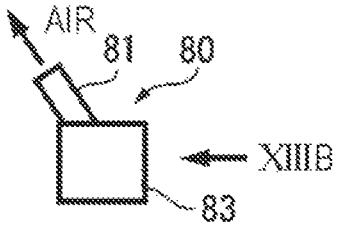
FIG. 13A is a diagram of the air handling mechanism in FIGS. 7.
Figure 13B:
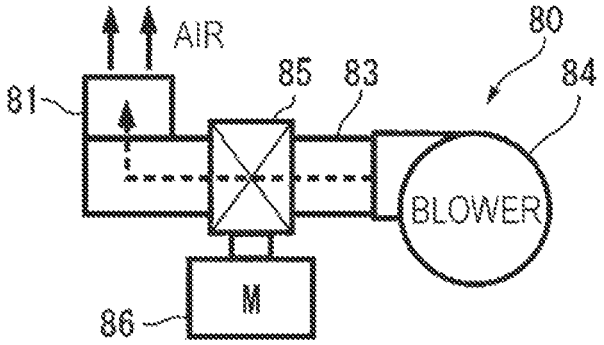
FIG. 13B is a diagram illustrating a state where air is blown when viewed in the direction of arrow XIIIB in FIG. 13A.
Figure 13C:
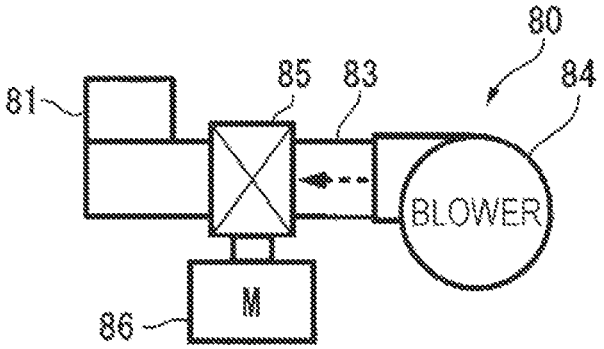
FIG. 13C is a diagram illustrating a state where air is not blown.

In this example, a shutter mechanism 75 that opens or shuts each of the air outlets 71 is disposed. As illustrated in FIGS. 11, 12A, and 12B, the shutter mechanism 75 includes a planar shutter 76 covering the air outlet 71 and a shutter driving mechanism 77 that vertically moves the shutter 76 in a reciprocating manner. An example used as the shutter driving mechanism 77 in this case includes a driving motor 771 formed from a stepping motor, a driving transmission gear 772 coaxial with a driving shaft of the driving motor 771, a shutter support member 773 that supports a lower portion of the shutter 76, a rack 774 vertically extending at a side edge of the shutter support member 773, and a driving transmission gear train 775 disposed between the rack 774 and the driving transmission gear 772 to engage the rack 774 and the driving transmission gear 772 with each other to transmit the driving force between the rack 774 and the driving transmission gear 772 via the driving transmission gear train 775. Thus, the driving force from the driving motor 771 driven based on the driving signal from a control device 200 is transmitted to the shutter 76.

Thus, in this example, each air outlet 71 is repeatedly opened and shut by the shutter mechanism 75. Thus, air blown from the air outlets 71 is capable of easily floating the upper portion of the medium S in a fluctuation pattern.

Air Handling Mechanism

In this example, as illustrated in FIGS. 4, 7, and 13A to 13C, the air handling mechanism 80 includes an air nozzle 81 that blows knife-shaped air to obliquely rearward from below to the end of the medium floated by the floating mechanism 70 in the discharging direction. An air guide plate 82 protrudes from a portion of the vacuum head 50 closer to the discharging rollers 40 to change the direction of air blown from the air nozzle 81, and to separate the media by blowing air between the upper medium floated by the floating mechanism 70 and the media located below the upper medium.

In this example, the air nozzle 81 is continuous with an air duct 83, to which an air blowing blower 84 is connected. Thus, at a portion of the air duct 83, an open-close valve 85 that opens or shuts the flow path is disposed. The open-close valve 85 is opened or shut by a valve motor 86. Thus, in this example, while the blower 84 is kept driving, air blown from the air nozzle 81 is switched by opening or shutting the open-close valve 85.

Auxiliary Suction Device

Particularly, the present exemplary embodiment includes an auxiliary suction device 120 that assists the vacuum head 50 in performing the medium air-suction operation.

<Layout of Auxiliary Suction Device>

In this example, as illustrated in FIGS. 4, 7, and 8, the auxiliary suction device 120 is disposed close to the vacuum head 50 on a side opposite to the side closer to the discharging member in the discharging direction in which the media S are discharged. In this example, the auxiliary suction device 120 is attached, with a holder bracket 121, to an outer surface of a side wall of the head frame 60 that supports the vacuum head 50 facing in a direction opposite to the discharging direction in which the media S are discharged.

In this example, the auxiliary suction device 120 is held by the head frame 60 while being not in contact with the vacuum head 50, but may be held by the head frame 60 while being in contact with the vacuum head 50. Specifically, in this example, the auxiliary suction device 120 may be located closer to the vacuum head 50 on the side opposite to the side closer to the discharging member in the discharging direction in which the media S are discharged regardless of whether the auxiliary suction device 120 is in contact with or not in contact with the vacuum head 50.

"Being located closer to the vacuum head 50" will be more specifically described now. In this example, for example, in relation to the positional relationship between an initial position of the end guide 33 when the media S with a size maximum receivable by the container 30 is accommodated and a side wall portion of the vacuum head 50 located on the side opposite to the side closer to the discharging member in the discharging direction in which the media S are discharged, when the auxiliary suction device 120 is located closer to the side wall portion of the vacuum head 50 than to the end guide 33, the auxiliary suction device 120 is regarded as "being located closer to the vacuum head 50".

Figure 15A:
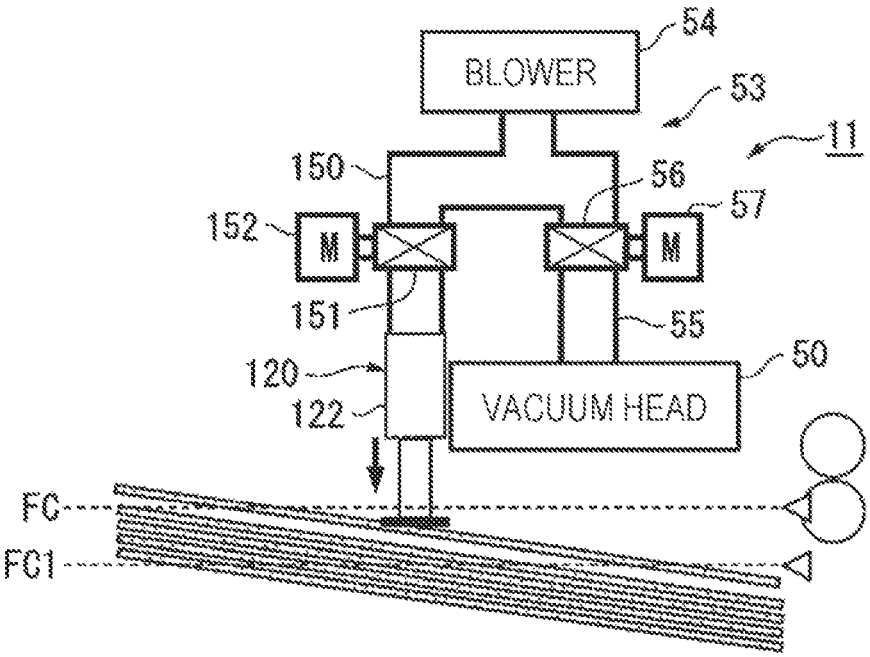
FIG. 15A is a diagram of a suction mechanism of the auxiliary suction device according to the first exemplary embodiment.

More specifically, for example, when media such as envelopes with an uneven thickness are accommodated in the container 30, as illustrated in FIG. 15A, the media S may be inclined inside the container 30. In this state, a portion of the uppermost medium S1 of the media S facing the vacuum head 50 may be located lower than the medium reference height FC, and thus the inclined medium S1 is more likely to fail to be sucked with air only by the vacuum head 50. To address such a technical problem, an appropriate layout of the auxiliary suction device 120 is found with reference to a medium with the maximum usable size because the auxiliary suction device 120 located away from the vacuum head 50 fails to assist the vacuum head 50 in air suction of media regardless of when being located on the side of the vacuum head 50 opposite to the side closer to the discharging member in the discharging direction in which the media are discharged.

Particularly, such a technical problem frequently occurs in handling frequently used envelopes of the sizes "K2", "K3", "N3", and "N4" in JIS. Thus, when such envelopes are used, the auxiliary suction device 120 is preferably located closer to the vacuum head 50 than to the position of the end guide 33 (the trailing end positions of these envelopes opposite to the leading end portions in the discharging direction in which the envelopes are transported).

Among these envelopes, N4 (width 90×length 205 mm) is the smallest size. In view of this size, the auxiliary suction device 120 is preferably located within 102.5 mm from the leading end of the envelope.

<Structure Example of Auxiliary Suction Device>

In this example, as illustrated in FIGS. 7 and 14A to 14C, the auxiliary suction device 120 includes a moving duct 122 that is expandable under its own weight.

Figure 14C:
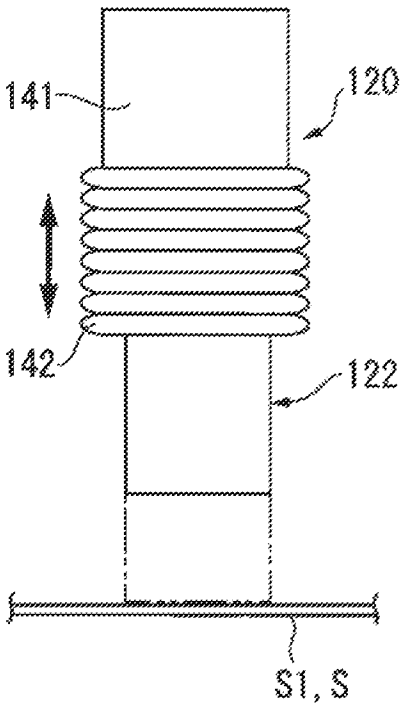
FIGS. 14A to 14C are diagrams of an auxiliary suction device according to the present exemplary embodiment, where
Figure 14B:
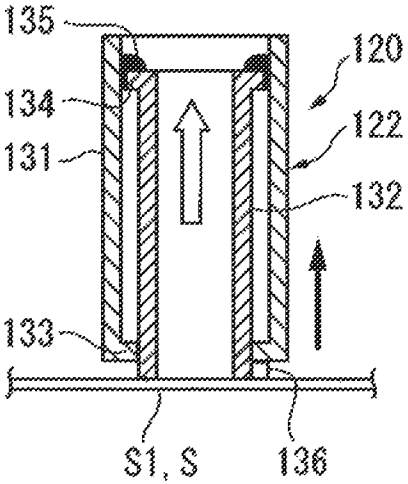
Figure 14A:
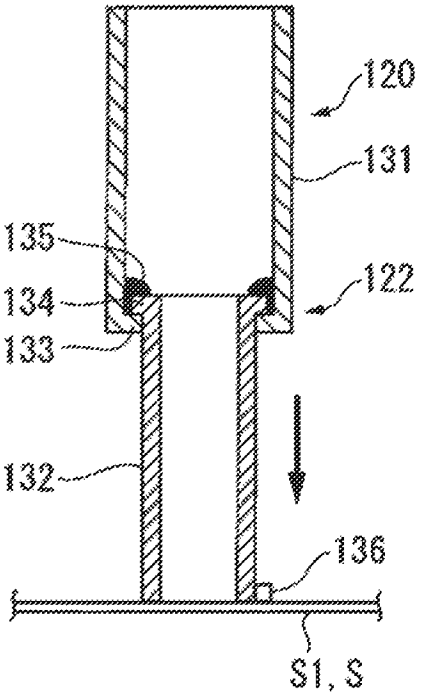

In this example, as illustrated in FIG. 14A, the moving duct 122 includes substantially cylindrical divided ducts 131 and 132, obtained by being divided into multiple (two in this example) pieces. The first divided duct 131 is slidably fitted onto the second divided duct 132 under its own weight. The first divided duct 131 has an inner flange 133 at the lower-end inner edge, the second divided duct 132 has an outer flange 134 at the upper-end outer edge, and the outer flange 134 of the second divided duct 132 is undetachably hooked on the inner flange 133 of the first divided duct 131. The outer flange 134 of the second divided duct 132 and the inner peripheral surface of the first divided duct 131 are hermetically sealed with an annular sealant 135. In addition, a stopper piece 136 that protrudes radially is installed at the lower-end outer edge of the second divided duct 132 after the second divided duct 132 is fitted into the first divided duct 131. The stopper piece 136 prevents the second divided duct 132 from being entirely drawn into the first divided duct 131.

In this example, as illustrated in FIG. 14A, when the first divided duct 131 in the moving duct 122 in the auxiliary suction device 120 is held by the holder bracket 121 (refer to FIG. 7), the second divided duct 132 fitted into the first divided duct 131 falls downward under its own weight, and the moving duct 122 extends to arrive at the uppermost medium S1 of the media S in the container 30. At this time, the second divided duct 132 is extendable downward until the outer flange 134 abuts against the inner flange 133 of the first divided duct 131 at the maximum, but the second divided duct 132 stops when abutting against the uppermost medium S1 of the media S in the container 30.

In this case, as illustrated in FIG. 15A, a lower end position FC1 to which the moving duct 122 is extended at the maximum under its own weight is set lower than the medium reference height FC, and appropriately selected within a range within which the moving duct 122 is capable of coming into contact with the uppermost medium S1 of the media S such as envelopes loaded in the container 30 while being inclined.

In this state, when the auxiliary suction device 120 is sucked by a suction mechanism described later, as illustrated in FIG. 14B, the far end of the moving duct 122 sucks the medium S1 with air, and is thus shut by the medium S1. Thus, the second divided duct 132 is drawn into the first divided duct 131 with the air suction force, and the moving duct 122 is switched from an extended state to a contracted state.

<Another Structure Example of Auxiliary Suction Device>

In this example, the auxiliary suction device 120 includes the moving duct 122 including multiple expandable divided ducts 131 and 132, but this is not an only possible example.

For example, as illustrated in FIG. 14C, an elastically deformable bellows 142 may be disposed at a portion of a resin-made duct body 141 to allow the duct body 141 to extend under its own weight using this elastic deformation of the bellows 142.

<Suction Mechanism of Auxiliary Suction Device>

In this example, the moving duct 122 in the auxiliary suction device 120 has its upper end portion connected to the suction mechanism. In this case, a suction mechanism dedicated for the auxiliary suction device 120 may be used, but in this example, as illustrated in FIG. 15A, the suction mechanism 53 in the vacuum head 50 is used also as the suction mechanism for the auxiliary suction device 120.

In this example, the suction mechanism 53 for the auxiliary suction device 120 includes a diverging connection duct 150. The diverging connection duct 150 diverges from a connection duct 55 that connects the suction blower 54 and the vacuum head 50, connects the diverging connection duct 150 and the upper end portion of the moving duct 122 in the auxiliary suction device 120, and opens or shuts, with a valve motor 152, an open-close valve 151 disposed at a portion of the diverging connection duct 150 to open or shut the flow path.

<Air Suction Operation of Auxiliary Suction Device and Vacuum Head>

Figure 15B:
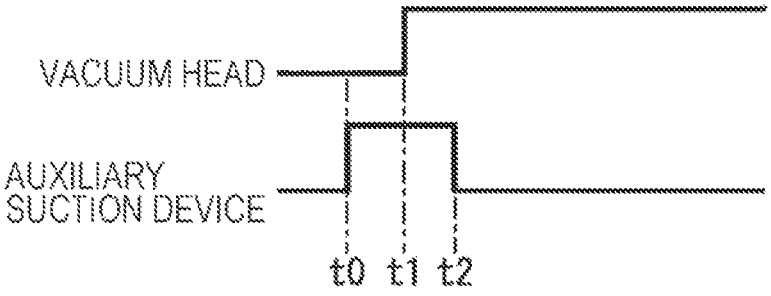
FIG. 15B is a timing chart of an air-suction operation performed by a vacuum head and an auxiliary suction device.

In this example, as illustrated in FIG. 15B, the auxiliary suction device 120 opens the open-close valve 151 at a timing to earlier than the vacuum head 50 to start the air suction operation. Thereafter, the vacuum head 50 opens the open-close valve 56 at a timing t1 a predetermined time after the timing t0 to start the air suction operation. Thereafter, the auxiliary suction device 120 shuts the open-close valve 151 at a timing t2 a predetermined time after the timing t1 to finish the air suction operation.

Control System

As illustrated in FIG. 4, the present example includes the control device 200 that controls the medium feeding device 11. The control device 200 is formed from a microcomputer including various processors. In the embodiments above, the term "processor" refers to a processor in a broad sense. Examples of the processor include general processors (for example, a central processing unit or CPU) and dedicated processors (for example, a graphics processing unit or GPU, an application specific integrated circuit or ASIC, a field programmable gate array or FPGA, and a programmable logic device).

This control device 200 captures, into the processors, various information resulting from, for example, job identification, or signals from various sensors (such as the position sensor 45 and the height sensor 99), executes various programs preinstalled into a memory not illustrated, and transmits a predetermined control signal to each control target.

In this example, examples of the control target include the discharging rollers 40, the vacuum head 50 (the suction mechanism 53, and the forward/rearward moving mechanism 61), the floating mechanism 70, the air handling mechanism 80, the hoist mechanism 90, and the auxiliary suction device 120. The control device 200 includes a display 210 that displays the processing state of the medium feeding job or a warning indicating an abnormal state in medium feeding.

Medium Feeding Operation Process

First, a basic medium feeding operation process of a medium feeding device according to an exemplary embodiment will be described with reference to FIGS. 16A to 16E.

Figure 16A:
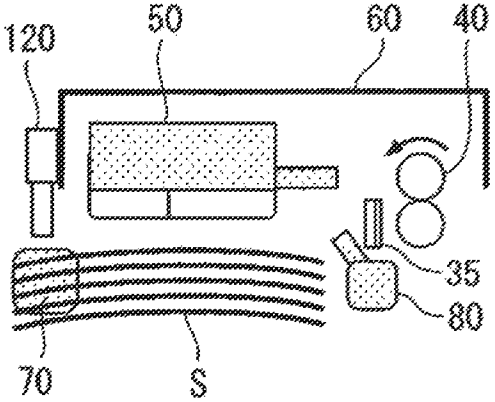
FIGS. 16A to 16E are diagrams of a basic medium feeding operation process performed by the medium feeding device according to the first exemplary embodiment.

First, as illustrated in FIG. 16A, the floating mechanism 70 blows floating air from a side of a medium pile to float some upper sheets in the medium pile to the positions to be sucked by the vacuum head 50 with air.

Figure 16B:
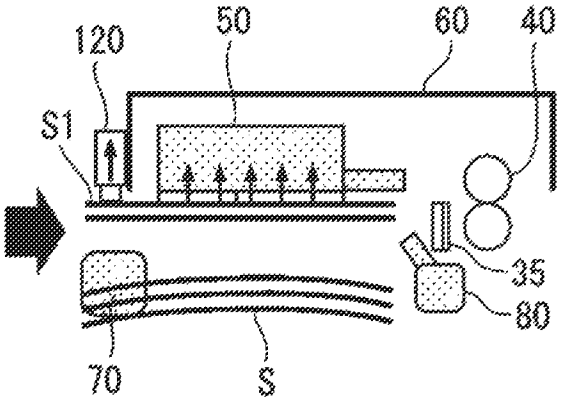

In this state, as illustrated in FIG. 16B, the auxiliary suction device 120 opens the open-close valve 56 in the suction mechanism 53 in the vacuum head 50 to cause the vacuum head 50 to form a negative pressure. Thus, the vacuum head 50 sucks the floating medium S1 located uppermost with air. At this time, the vacuum head 50 has a recessed portion between the surrounding skirt portion 51*a* and the surfaces of the vacuum holes 52 in the head body 51. Thus, the medium S1 is deformed along the recessed portion, and the skirt portion 51*a* disposed to tightly close the negative pressure area is also raised together with the medium S1.

Particularly, in the present example, the auxiliary suction device 120 performing air suction of media assists the vacuum head 50 in air suction of the media S. This will be described in detail later.

Figure 16C:
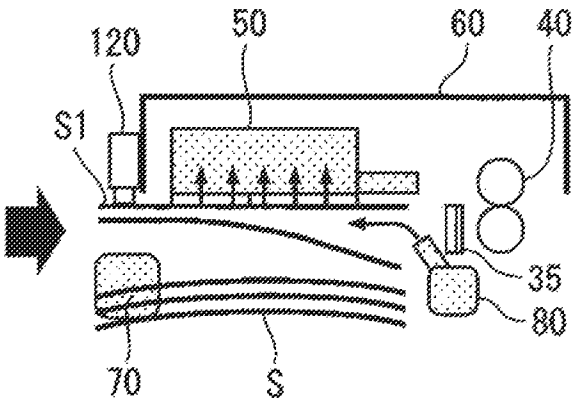

Thereafter, as illustrated in FIG. 16C, the open-close valve 85 in the air handling mechanism 80 is opened, air is applied to the air guide plate 82 located on the side of the vacuum head 50 facing in the discharging direction, to insert separating air between the uppermost medium S1 sucked by the vacuum head 50 with air and the second and lower media S located below the uppermost medium S1, and the second and lower media S following the uppermost medium S are dropped down with air.

Figure 16D:
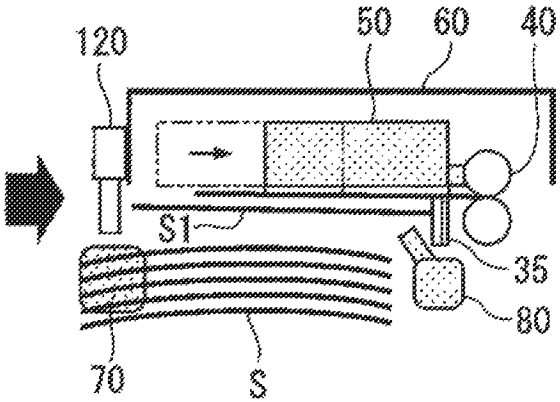

Thereafter, as illustrated in FIG. 16D, the vacuum head 50 holding the uppermost medium S1 moves forward toward the discharging rollers 40, the vacuum head 50 passes the medium S1 to the discharging rollers 40, and then the open-close valve 56 in the vacuum head 50 and the open-close valve 85 in the air handling mechanism 80 are shut.

Figure 16E:
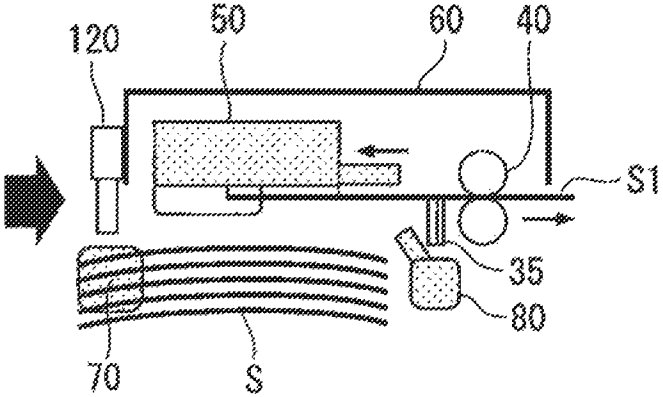

Thereafter, as illustrated in FIG. 16E, the vacuum head 50 is returned to the initial position to be ready for the next medium feeding operation.

<Timing Chart of Each Device>

Figure 17:
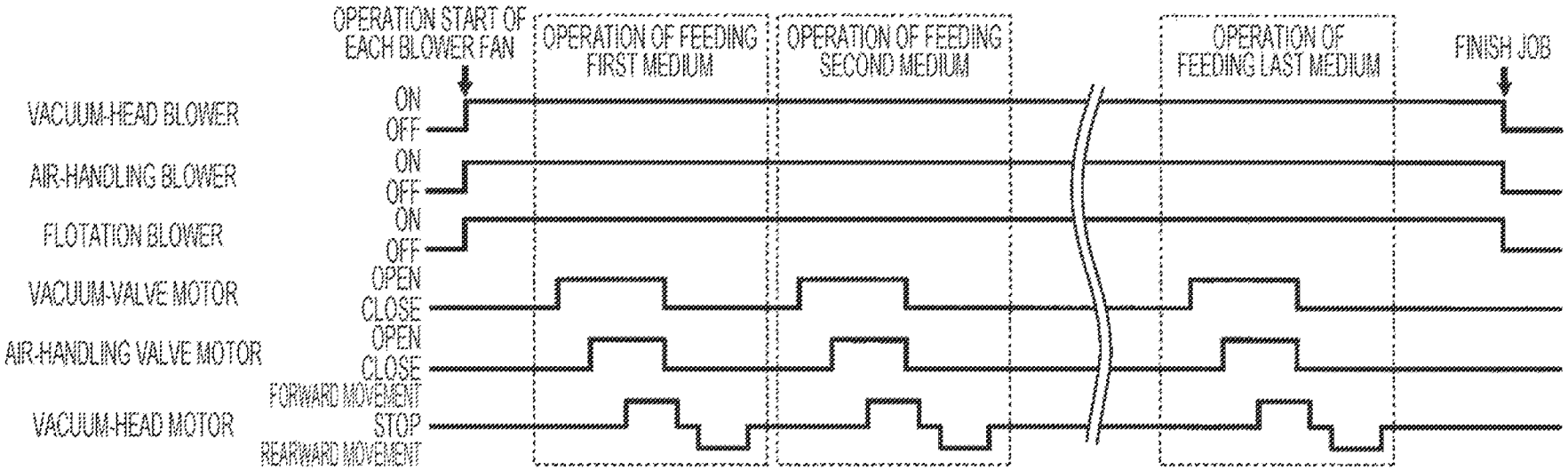
FIG. 17 is a timing chart of a basic medium feeding operation performed by the medium feeding device illustrated in FIGS. 16A to 16E.

FIG. 17 is a timing chart of each device in the above medium feeding operation process.

In FIG. 17, "a vacuum-head blower" corresponds to "the blower 54" (refer to FIGS. 10A and 10B) in the suction mechanism 53, "an air-handling blower" corresponds to "the blower 84" (refer to FIGS. 13A to 13C) in the air handling mechanism 80, and "a flotation blower" corresponds to "the blower 73" (refer to FIG. 11) in the floating mechanism 70.

"A vacuum-valve motor" corresponds to the valve motor 57, "an air-handling valve motor" corresponds to the valve motor 86, and "a vacuum-head motor" corresponds to the stepping motor 62 in the forward/rearward moving mechanism 61.

In this example, "the vacuum-head blower", "the air-handling blower", and "the flotation blower" are kept on during the medium feeding job. "The vacuum-valve motor", "the air-handling valve motor", and "the vacuum-head motor" repeat on/off control for each sheet medium to repeatedly perform suction and forward/rearward movement with the vacuum head 50 and feeding and stopping feeding of separation air from the air handling mechanism 80.

Operation of Auxiliary Suction Device

In this example, the auxiliary suction device 120 has the following three structural features.

The first feature is that the auxiliary suction device 120 is located closer to the vacuum head 50 on the side opposite to the side closer to the discharging member in the discharging direction in which the media are discharged.

The second feature is that the auxiliary suction device 120 sucks the media S with air earlier than the vacuum head 50 does.

The third feature is that the auxiliary suction device 120 sucks the media S with air at a position lower than the medium reference height FC.

Thus, the auxiliary suction device 120 according to the present exemplary embodiment has the following operations.

In this example, as illustrated in FIG. 15A, before starting the air suction operation, the auxiliary suction device 120 has the moving duct 122 extending downward under its own weight.

Figure 19A:
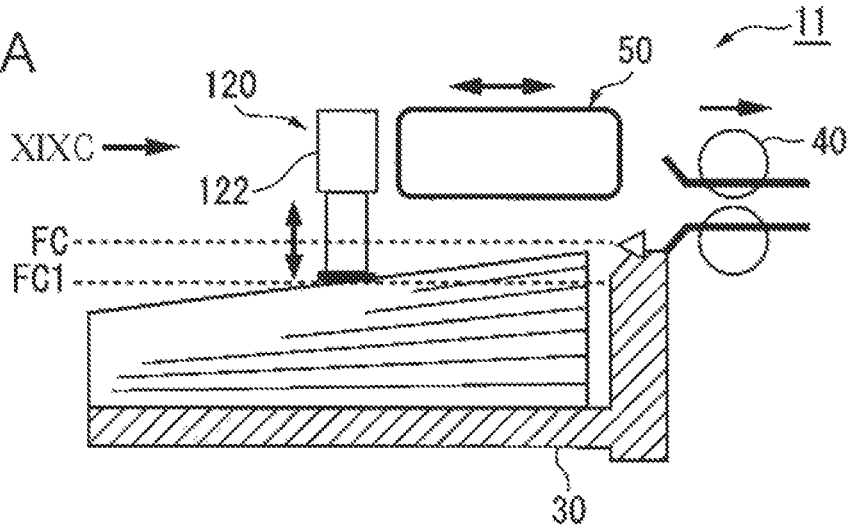
FIG. 19A is a diagram illustrating a first step in the medium air-suction operation procedure performed by the auxiliary suction device.

Particularly, in this example, as illustrated in FIG. 19A, the lower end portion of the moving duct 122 in the auxiliary suction device 120 is set at the position FC1 lower than the medium reference height FC. Thus, regardless of when the media S accommodated in the container 30 are media with an uneven thickness such as envelopes, and are inclined with respect to the container 30 while having the end of the media S in the discharging direction in which the media S are discharged lowered, the lower end opening of the auxiliary suction device 120 is located in contact with or adjacent to the surface of the uppermost medium S1 in the pile of the media S.

In this state, when upper sheets in the media S are floated by the floating mechanism 70, the lower end opening of the auxiliary suction device 120 comes into contact with the floating uppermost medium S1.

In this example, as illustrated in FIG. 18A, in order to start the air suction operation earlier than the vacuum head 50, the auxiliary suction device 120 sucks the medium S1 with air at the lower end opening, and transports the medium S1 to an upper position while sucking the medium S1 with air and contracting the second divided duct 132 in the moving duct 122.

Figure 19B:
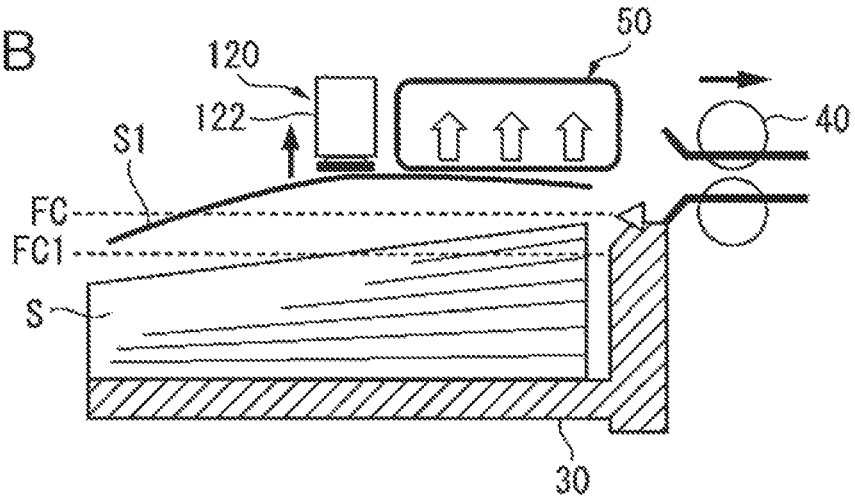
FIG. 19B is a diagram illustrating a subsequent stop in the air-suction operation procedure.

In this state, as illustrated in FIG. 19B, the medium S1 sucked and held by the auxiliary suction device 120 is raised upward by the medium reference height FC to approach the suction surface of the vacuum head 50.

Figure 18B:
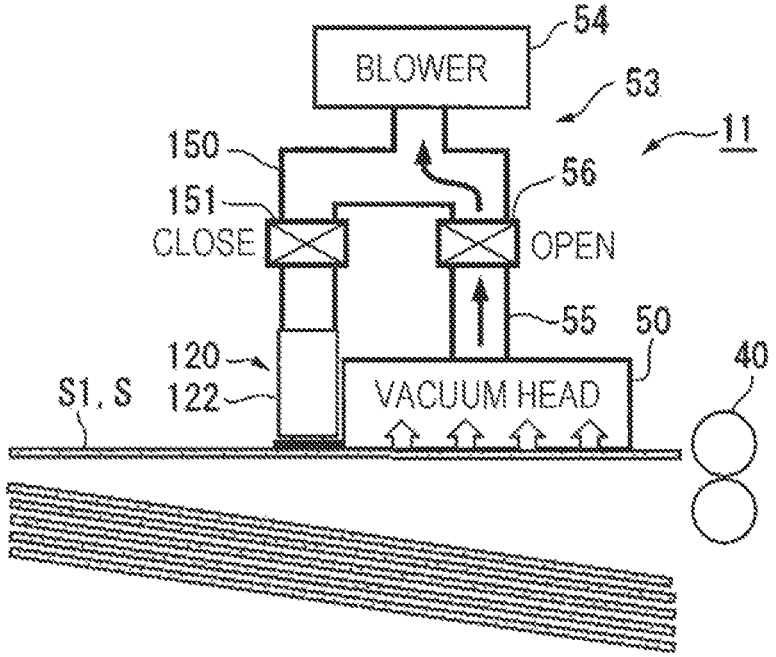
FIG. 18B is a diagram of the procedure of a medium suction operation performed by the vacuum head.

Thereafter, as illustrated in FIG. 18B, when the vacuum head 50 starts the air suction operation, the medium S1 is sucked by the vacuum head 50 with air, and the air-suction operation of the medium S1 is handed over from the auxiliary suction device 120 to the vacuum head 50.

During this period, as illustrated in FIG. 15B, the auxiliary suction device 120 and the vacuum head 50 concurrently keep performing the air suction operation for a predetermined time period, and thus the air-suction operation of the media S is stably handed over to the vacuum head 50.

Thereafter, when the auxiliary suction device 120 finishes the air suction operation, the vacuum head 50 moves toward the discharging rollers 40 while sucking the media S with air, and passes the medium S1 to the discharging rollers 40. During this period, the auxiliary suction device 120 finishes the air-suction operation of the medium S1. Thus, the operation of transporting the media S performed by the vacuum head 50 is not interrupted by the auxiliary suction device 120.

Figure 19C:
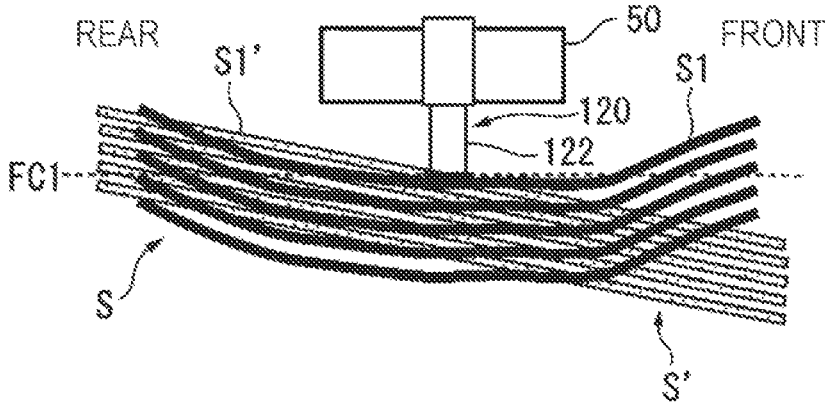
FIG. 19C is a diagram viewed in a direction of arrow XIXC-XIXC in FIG. 19A.

In this example, as illustrated in FIG. 19C, the auxiliary suction device 120 is installed at substantially the center of the head frame 60 in the width direction, while being extended to the position FC1 lower than the medium reference height FC. Thus, regardless of when the media S accommodated in the container 30 are deformed in a recessed shape in a width direction or a front-rear direction crossing the discharging direction in which the media S are discharged or when media S' are accommodated while being inclined in the width direction, the auxiliary suction device 120 in this example is securely capable of sucking uppermost medium S1 or S1' with air.

First Comparative Example

To evaluate the performance of the medium feeding device 11 according to the present exemplary embodiment, a medium feeding device according to a first comparative example will be described.

Figure 20A:
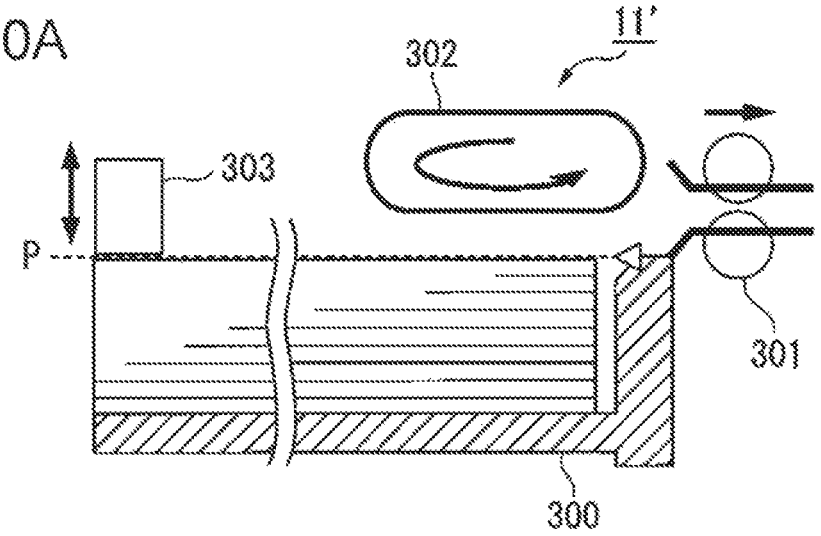
FIG. 20A is a diagram of a medium feeding device according to a first comparative example.

As illustrated in FIG. 20A, a medium feeding device 11' according to the first comparative example includes a container 300 that accommodates a pile of the media S, discharging rollers 301 that discharge the media S one by one, a vacuum belt 302 disposed above the container 300 and at a position closer to the discharging rollers 301 to suck and transport the leading end of the media S in the discharging direction, a trailing-end sucking portion 303 disposed above the container 300 and at a trailing end portion on a side away from the discharging roller 301 to suck the trailing end of the media S in the discharging direction, and an air blower (not illustrated) that blows air to the media S from the side of the container 300 to float the upper portion of the media S.

Particularly, in this example, the trailing-end sucking portion 303 includes a moving portion that is movable vertically or perpendicular to the uppermost surface of the media S accommodated in the container 300, and a blower that causes a suction force with which the uppermost medium S1 is sucked by the moving portion. While not sucking the media S, the moving portion moves downward to come into contact with the uppermost medium S1, and when sucking the medium S1, the moving portion moves upward to separate the trailing end of the medium S1 from other media S.

In addition, the trailing-end sucking portion 303 is fixed to an upper portion of a trailing-end restricting member that restricts the trailing end position of the media S accommodated in the container 300, and located corresponding to the trailing end position of the media S.

In FIG. 20A, a lower-end movable position P of the trailing-end sucking portion 303 corresponds to the position of a predetermined medium S located uppermost in the container 300.

Figure 20B:
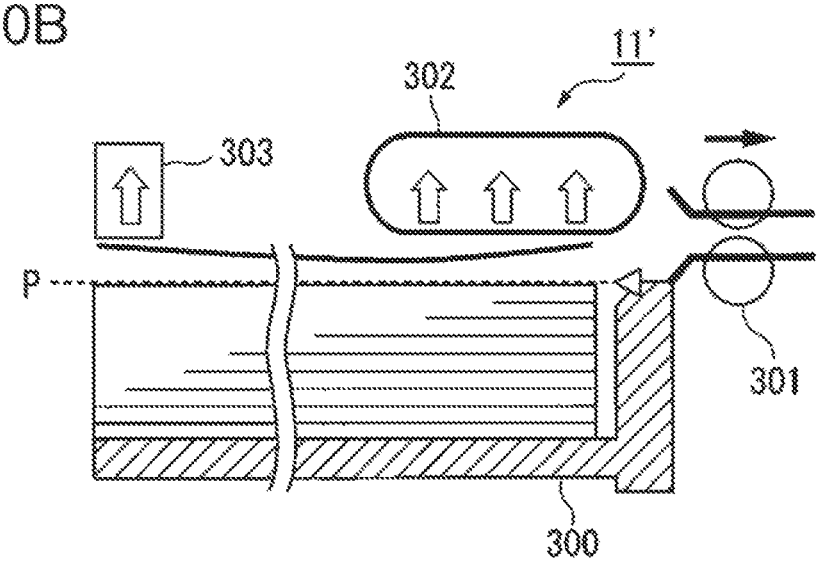
FIG. 20B is a diagram of a medium feeding operation procedure.
Figure 20C:
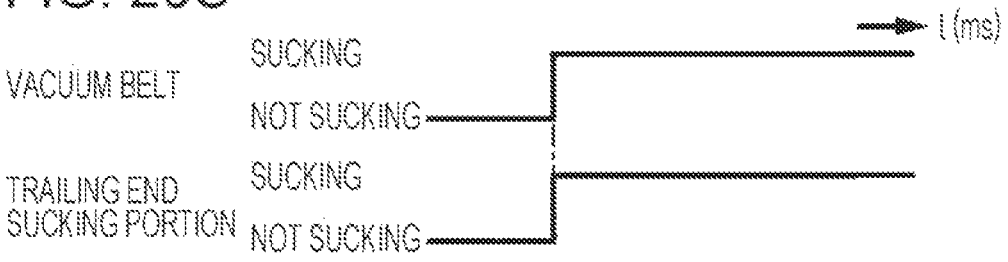
FIG. 20C is a timing chart of an air-suction operation performed by a vacuum belt and a trailing-end suction device.

In this example, as illustrated in FIG. 20C, the vacuum belt 302 and the trailing-end sucking portion 303 concurrently start the air-suction operation.

In this example, as illustrated in FIG. 20B, the vacuum belt 302 sucks with air the leading end portion of the uppermost medium S1 among the media S floated with air blown from an air blower not illustrated, and the trailing-end sucking portion 303 is lowered to a predetermined lower-end movable position P to suck the trailing end portion of the uppermost medium S1 with air, and then moves to an upper position. In this state, the vacuum belt 302 and the trailing-end sucking portion 303 suck and hold the uppermost medium S1, and then transport the medium S1 sucked and held by the vacuum belt 302 toward the discharging roller 301.

In this case, when the medium S1 is transported toward the discharging roller 301, the medium S1 deviates from the surface of the trailing-end sucking portion 303 for sucking the medium S1, and thus, the trailing-end sucking portion 303 moves downward to come into contact with the next uppermost media S.

In this example, the vacuum belt 302 and the trailing-end sucking portion 303 thus suck and hold the leading end portion and the trailing end portion of the medium S1 in the discharging direction, and pass the medium S1 to the discharging roller 301. Thus, to feed a medium S that is long in the discharging direction, regardless of when the separating air from the air blower fails to arrive at the trailing end of the medium S1, the long medium S1 is allowed to be sucked and held, and passed to the discharging roller 301.

Specifically, in the present example, as long as the media S are accommodated in the container 300 while remaining in a substantially horizontal position, the vacuum belt 302 and the trailing-end sucking portion 303 are capable of sucking and holding the medium S1, and effectively perform the medium feeding operation. However, as in the present exemplary embodiment, when media S with uneven thickness such as envelopes are accommodated, the media S may be inclined, and the uppermost medium S1 may be located lower than the predetermined lower-end movable position P. Thus, the vacuum belt 302 or the trailing-end sucking portion 303 may fail to suck the medium S1 with air.

This example is not designed assuming such a case of the media S disposed in an inclined position, and thus is unable to address medium feeding failures caused by such inclination.

In the present exemplary embodiment, the auxiliary suction device 120 includes an expandable moving duct 122 that extends downward under its own weight, but the structure example (FIGS. 14A to 14C) according to the first exemplary embodiment is not the only possible structure. For example, a modification example 1-1 or a modification example 1-2 may be employed instead.

Modification Example 1-1

Figure 21C:
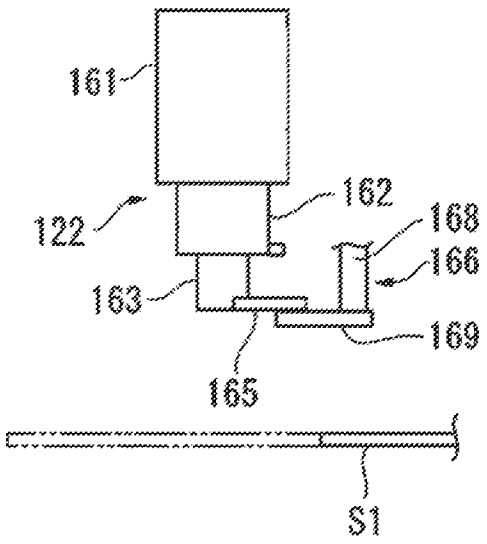
FIG. 21C is a diagram of an example use of the auxiliary suction device according to the first modification example.
Figure 21B:
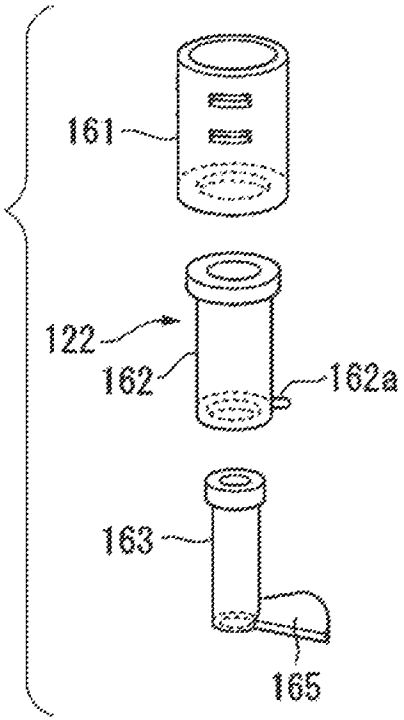
FIG. 21B is a diagram of an expandable moving duct included in the auxiliary suction device in FIG. 21A.
Figure 21A:
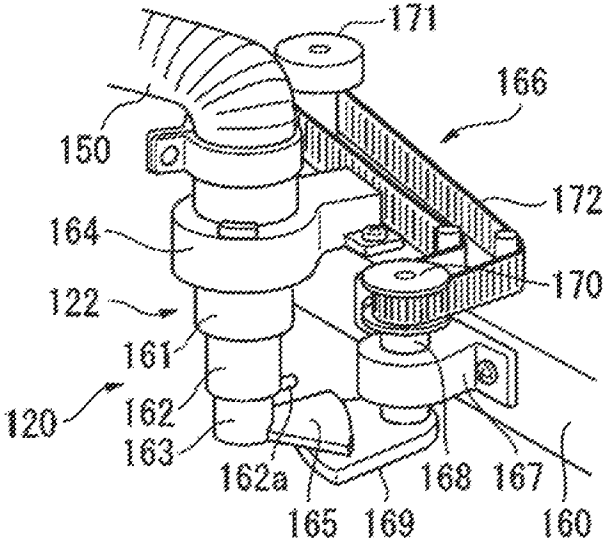
FIG. 21A is a diagram of an auxiliary suction device according to a first modification example obtained by modifying the first exemplary embodiment.

FIG. 21A illustrates an auxiliary suction device 120 according to a first modification example.

In FIG. 21A, the auxiliary suction device 120 includes an expandable moving duct 122. For example, as illustrated in FIG. 20B, multiple (three in this example), substantially cylindrical large, middle, and small divided ducts 161 to 163 are expansively and undetachably fitted to each other to extend the duct length under their own weight.

In this example, the large-diameter divided duct 161 in the moving duct 122 is held by a portion of the head frame 60 with a holder bracket 164. A protruding piece 165 that radially protrudes is installed at a lower end portion of the circumferential surface of the small-diameter divided duct 163 in the moving duct 122. The protruding piece 165 is stopped by a stopper mechanism 166 at a predetermined position to keep the moving duct 122 in a contracted initial state. A stopper piece 162*a* radially protrudes from the lower-end outer edge of the middle-diameter divided duct 162 to restrict the contracting operation of the middle-diameter divided duct 162 when the moving duct 122 is contracted.

The reason why the stopper mechanism 166 is installed is to hold the auxiliary suction device 120 in an unused state to prevent the auxiliary suction device 120 from interfering with other components when the media S accommodated in the container 30 are small and when the media S are not located at the portion facing the auxiliary suction device 120.

In the stopper mechanism 166 in this example, a stopper piece 169 radially protrudes at the lower end of a rotation shaft 168 rotatably held by a bearing holder 167. A transmission gear 170 is disposed on the rotation shaft 168 to be coaxial with the rotation shaft 168. A driving transmission belt 172 is wound around the transmission gear 170 and a driving gear 171 coupled to a driving motor shaft not illustrated. The rotation shaft 168 swings within, for example, a predetermined angle range. The stopper mechanism 166 swings the stopper piece 169 between a stop position where the protruding piece 165 is stopped and a stop release position where the protruding piece 165 is not stopped.

As illustrated in FIG. 21C, when the auxiliary suction device 120 is unused, the stopper mechanism 166 stops the protruding piece 165 at the stop position to hold the moving duct 122 in the contracted initial state. When the auxiliary suction device 120 is used, the stopper mechanism 166 is detached from the protruding piece 165 to allow the moving duct 122 to extend downward under its own weight.

Modification Example 1-2

Figure 22A:
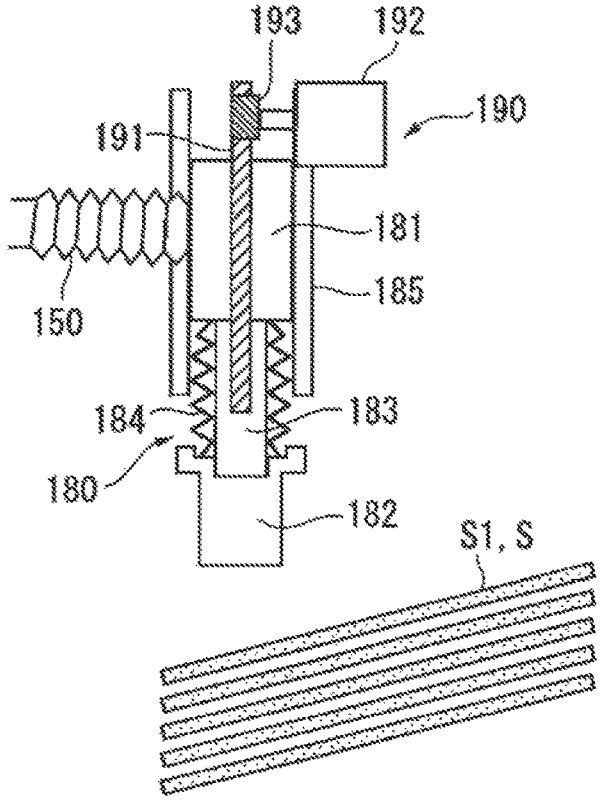
FIG. 22A is a diagram of an auxiliary suction device according to a second modification example obtained by modifying the first exemplary embodiment.

FIG. 22A illustrates an auxiliary suction device 120 according to a modification example 1-2.

In FIG. 22A, similarly to the first exemplary embodiment, the auxiliary suction device 120 includes a moving duct. However, unlike the first exemplary embodiment and the modification example 1-1, the auxiliary suction device 120 includes a moving duct 180 vertically moved by a driving mechanism 190 instead of being expandable under its own weight.

In this example, the moving duct 180 includes a second duct element 182 coupled, with a middle duct element 183 interposed therebetween, to a first duct element 181 connected to the diverging connection duct 150. In this case, the first duct element 181 is held while being vertically movable along a guide rail 185. An elastic spring 184 is interposed between the first duct element 181 and the second duct element 182. The first duct element 181 and the middle duct element 183 are relatively movably coupled together. The second duct element 182 and the middle duct element 183 are immovably coupled together.

The driving mechanism 190 includes a worm gear 191 extending along the guide rail 185. The worm gear 191 is engaged with a driving gear 193 coaxially fixed with the driving shaft of a driving motor 192 to vertically move the first duct element 181 with rotation of the worm gear 191.

Figure 22B:
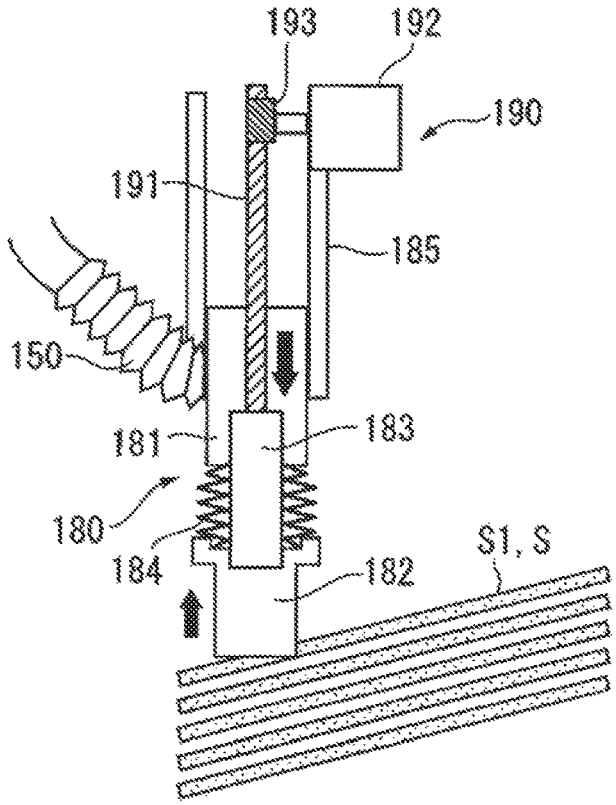
FIG. 22B is a diagram of an operation example of the auxiliary suction device.

In this example, as illustrated in FIG. 22A, the auxiliary suction device 120 when unused may keep the moving duct 180 at an upper position away from the media S. As illustrated in FIG. 22B, the auxiliary suction device 120 when used may move downward to bring the lower end opening of the moving duct 180 into contact with the uppermost medium S1, and then move to the upper position while starting the air suction operation.

In this example, in the moving duct 180, the elastic spring 184 allows the first duct element 181 and the second duct element 182 to be elastically deformed. Thus, as illustrated in FIG. 22B, regardless of when the far end portion of the second duct element 182 forcibly comes into contact with the medium S1, the excess force is absorbed by the elastic spring 184.

Second Exemplary Embodiment

Figure 23A:
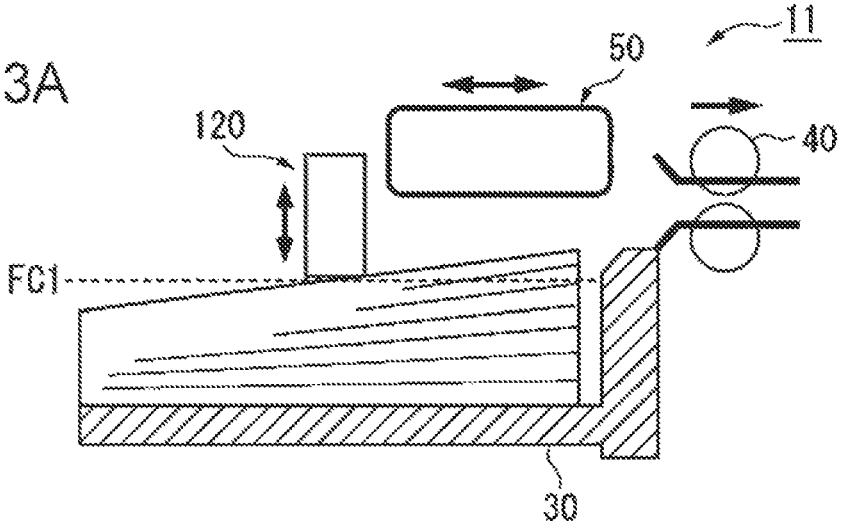
FIG. 23A is a diagram of a related portion of a medium feeding device according to a second exemplary embodiment.

FIG. 23A illustrates a related portion of a medium feeding device according to a second exemplary embodiment.

Figure 23B:
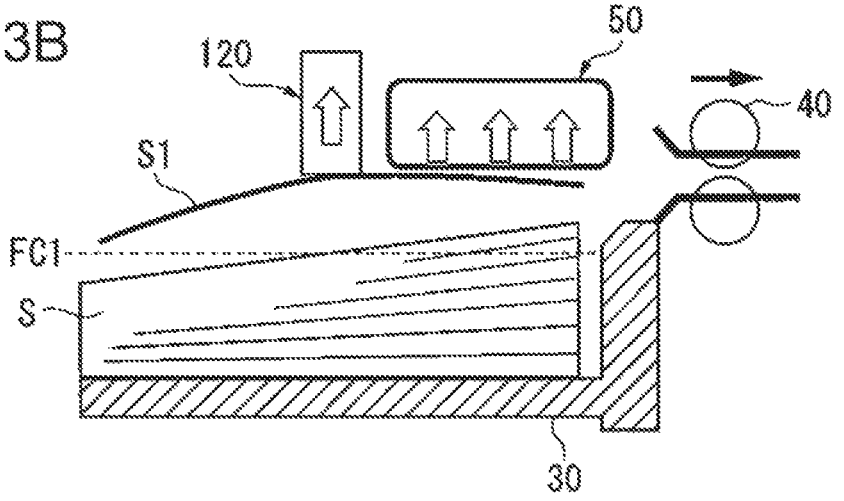
FIG. 23B is a diagram of a suction operation procedure performed by the medium feeding device.

In FIG. 23A, the medium feeding device 11 has substantially the same structure as the first exemplary embodiment, and includes a container 30, discharging rollers 40, a vacuum head 50, a floating mechanism not illustrated, and an auxiliary suction device 120. The auxiliary suction device 120 is vertically movable. The auxiliary suction device 120 sucks the media S with air at a position FC1 lower than the medium reference height FC, and moves to the upper position as illustrated in FIG. 23B.

Figure 23C:
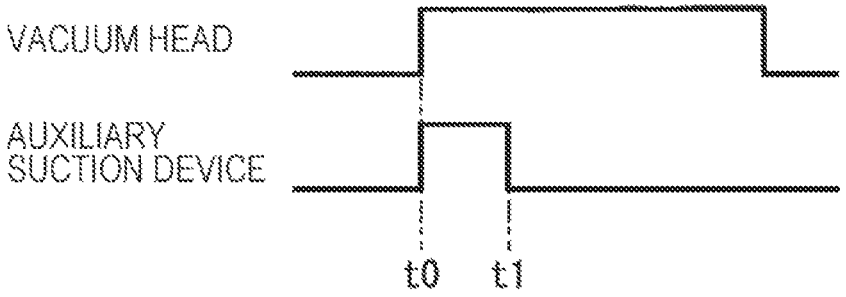
FIG. 23C is a timing chart of an air-suction operation performed by the vacuum head and the auxiliary suction device.

However, as illustrated in FIG. 23C, unlike the first exemplary embodiment, the auxiliary suction device 120 according to the present exemplary embodiment starts the air suction operation concurrently (at a timing t0) with the vacuum head 50, and finishes the air-suction operation at a timing t1 a predetermined time after the start. The vacuum head 50 keeps the air suction operation also after the auxiliary suction device 120 finishes the air suction operation, moves toward the discharging rollers 40 while sucking and holding the medium S1, and passes the medium S1 to the discharging rollers 40.

In this example, the auxiliary suction device 120 starts the air suction operation concurrently with the vacuum head 50. After sucking the uppermost medium S1 with air while being located closer to the uppermost medium S1 than the vacuum head 50, the auxiliary suction device 120 raises the medium S1 to the upper position. Thus, after the vacuum head 50 starts the air suction operation and the medium S1 approaches the suction surface of the vacuum head 50, the vacuum head 50 sucks the medium S1 with air.

Third Exemplary Embodiment

Figure 24A:
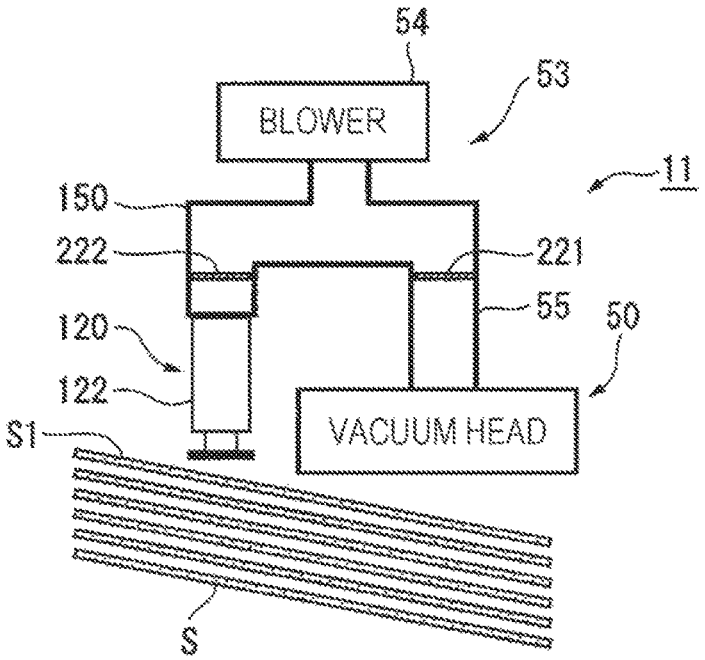
FIG. 24A is a diagram of a related portion of a medium feeding device according to a third exemplary embodiment.

FIG. 24A illustrates a related portion of a medium feeding device according to a third exemplary embodiment.

In FIG. 24A, the basic structure of the medium feeding device 11 is substantially the same as that of the first exemplary embodiment. The medium feeding device 11 performs the air suction operation with the suction mechanism 53 used in common by the vacuum head 50 and the auxiliary suction device 120, but differs from that according to the first exemplary embodiment in the structures of the open-close valves 56 and 151.

Figure 24B:
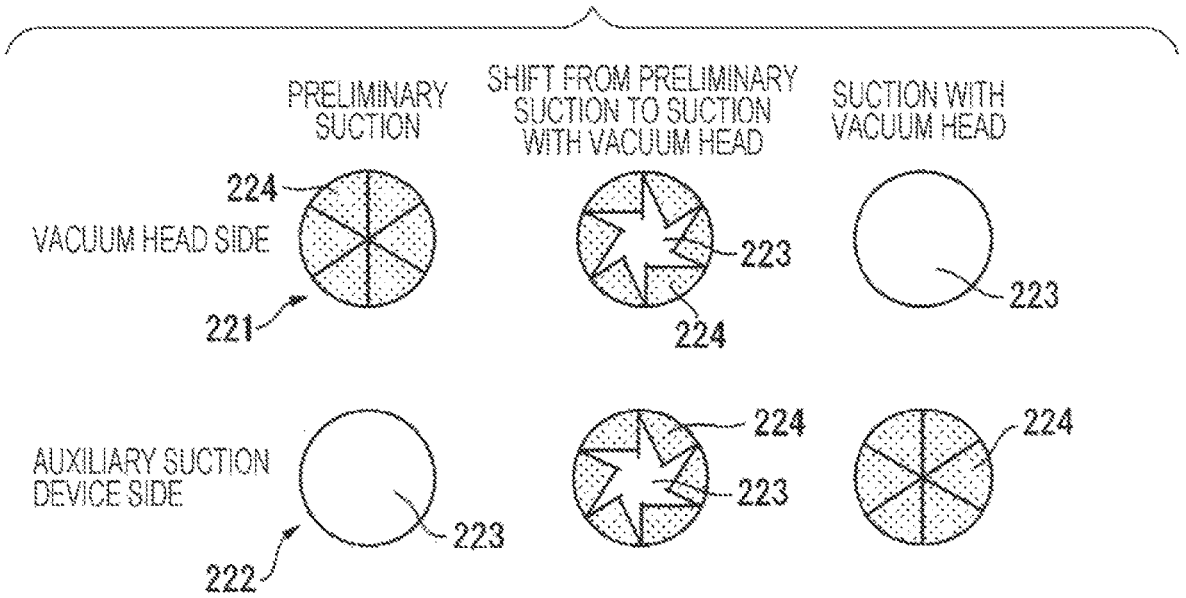
FIG. 24B is a diagram of a valve that controls air suction and the operation examples of the valve.

In this example, as illustrated in FIGS. 24A and 24B, shutter valves 221 and 222 having the opening degree adjustable are used as open-close valves for the vacuum head 50 and the auxiliary suction device 120. The shutter valves 221 and 222 have a structure corresponding to the structure of a camera shutter, and form a flow path opening 223 with a shutter member 224 into a completely-shut state, a fully-open state, and a semi-open state in which the flow path is half shut and half open.

In this example, as illustrated in FIG. 24B, the auxiliary suction device 120 performs preliminary suction earlier than the vacuum head 50 while the shutter valve 222 is in the fully-open state, and then, when shifting from the preliminary suction to the operation of the vacuum head 50, performs air suction while the shutter valve 222 is in the semi-open state. Thereafter, the auxiliary suction device 120 finishes the air suction operation while the shutter valve 222 is in the completely-shut state.

On the other hand, as illustrated in FIG. 24B, when the auxiliary suction device 120 performs preliminary suction, the vacuum head 50 does not start the air suction operation while the shutter valve 221 is in the completely-shut state. Thereafter, when the preliminary suction performed by the auxiliary suction device 120 is to be shifted to the operation of the vacuum head 50, the vacuum head 50 starts air suction while the shutter valve 221 is in the semi-open state, and then keeps the air suction operation while the shutter valve 221 is in the fully-open state.

Thus, in this example, when the preliminary suction performed by the auxiliary suction device 120 is shifted to the operation performed by the vacuum head 50, the air suction is performed in the semi-open state in which the flow path is half shut and half open. After the air suction operation is handed over from the auxiliary suction device 120 to the vacuum head 50, the preliminary suction is finished, and the vacuum head 50 performs air suction while the shutter valve 221 is in the fully-open state. Thus, the suction force in the air suction is not reduced.

In the present exemplary embodiment, the shutter valves 221 and 222 are respectively used for the vacuum head 50 and the auxiliary suction device 120, but they are not the only possible examples. For example, as illustrated in modification examples 3-1 to 3-3, air suction of the vacuum head 50 and the auxiliary suction device 120 may be controlled by a single common valve 230 (refer to FIGS. 25A to 27B).

Modification Example 3-1

Figure 25A:
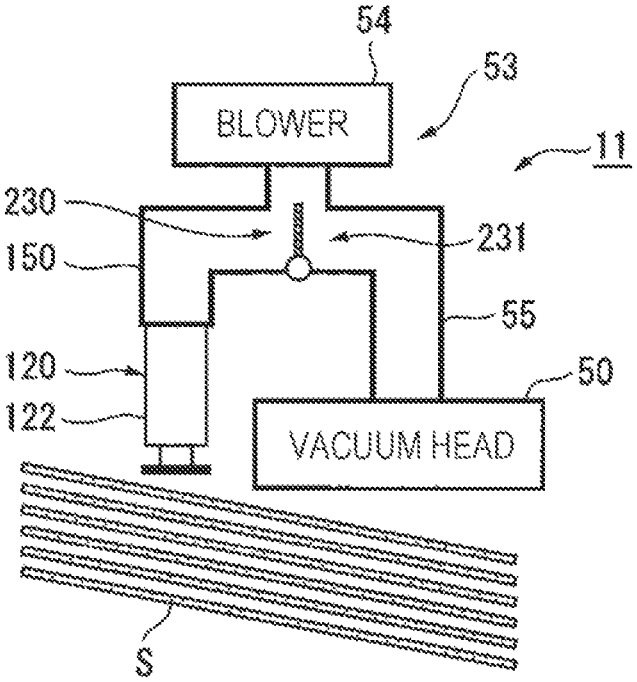
FIG. 25A is a diagram of a related portion of a medium feeding device according to a modification example 3-1.

FIG. 25A is a related portion of a medium feeding device according to the modification example 3-1.

In FIG. 25A, the basic structure of the medium feeding device 11 is substantially the same as that of the third exemplary embodiment, but differs from that of the third exemplary embodiment in that the common valve 230 is disposed at a diverging portion between the connection duct 55 and the diverging connection duct 150.

In this example, the diverging connection duct 150 diverges from the connection duct 55 to form a T-shaped space 231 having substantially a letter T shape. The common valve 230 swingably supports an elliptical valve plate 232 at a junction in the T-shaped space 231 around a swing support 233.

Figure 25B:
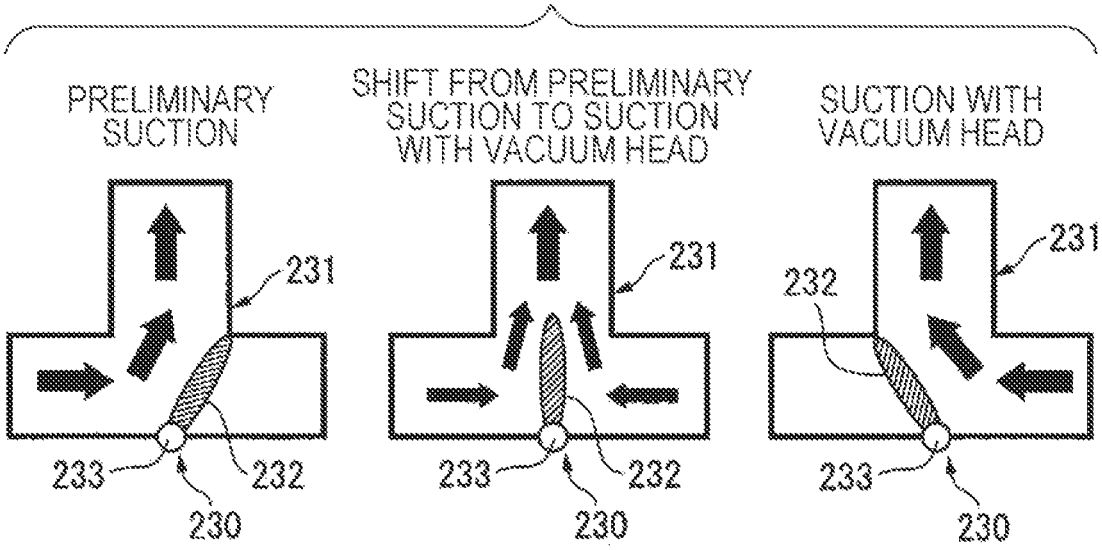
FIG. 25B is a diagram of a valve that controls air suction and the operation examples of the valve.

In this case, as illustrated in FIG. 25B, when the auxiliary suction device 120 performs preliminary suction, the common valve 230 shuts, with the valve plate 232, the flow path of the connection duct 55 continuous with the vacuum head 50. When the vacuum head 50 performs suction, the common valve 230 shuts, with the valve plate 232, the flow path of the diverging connection duct 150. When the preliminary suction is shifted to the operation of the vacuum head 50, the common valve 230 places the valve plate 232 at a neutral position to allow the auxiliary suction device 120 and the vacuum head 50 to concurrently perform suction to prevent reduction of the total suction force during the concurrent suction.

Modification Example 3-2

Figure 26A:
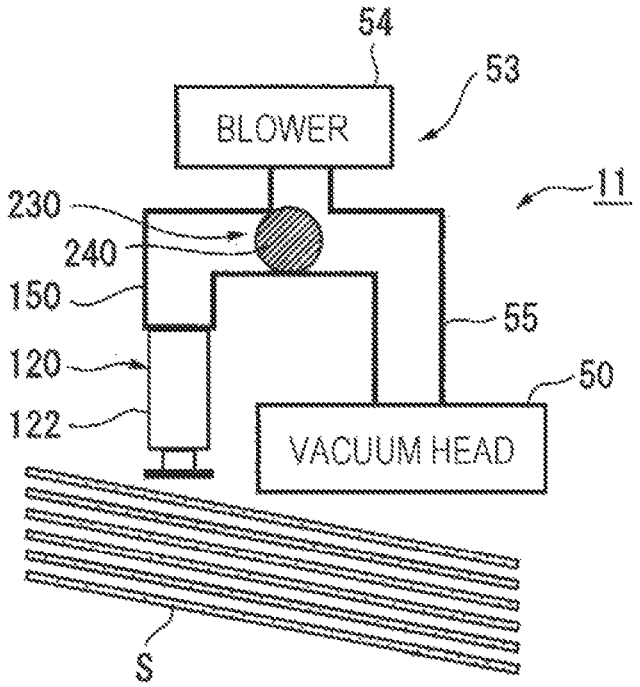
FIG. 26A is a diagram of a related portion of a medium feeding device according to a modification example 3-2.

FIG. 26A illustrates a related portion of a medium feeding device according to a modification example 3-2.

In FIG. 26A, the basic structure of the medium feeding device 11 is substantially the same as that of the modification example 3-1, and includes a T-shaped space 231 and a common valve 230, but differs from the modification example 3-1 in the structure of the common valve 230.

In this example, the common valve 230 includes a spherical valve sphere 240 slidably disposed in a horizontal space 231*a* including the junction in the T-shaped space 231.

Figure 26B:
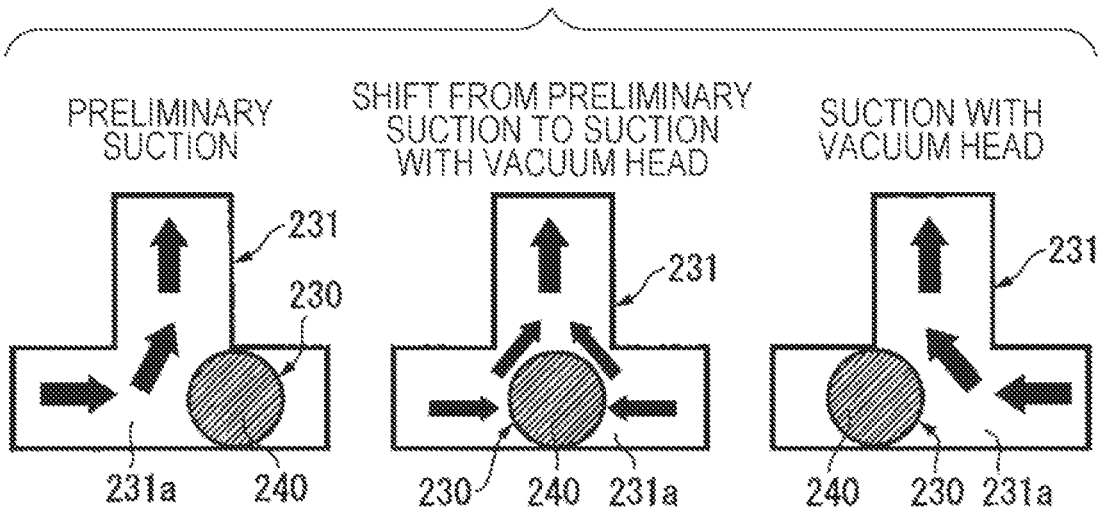
FIG. 26B is a diagram of a valve that controls air suction and the operation examples of the valve.

In this case, as illustrated in FIG. 26B, the common valve 230 shuts, with the valve sphere 240, the flow path of the connection duct 55 continuous with the vacuum head 50 when the auxiliary suction device 120 performs preliminary suction. When the vacuum head 50 performs suction, the valve sphere 240 shuts the flow path of the diverging connection duct 150. In addition, when the preliminary suction is shifted to the operation of the vacuum head 50, the common valve 230 places the valve sphere 240 in the neutral position to allow the auxiliary suction device 120 and the vacuum head 50 to concurrently perform suction, and prevent reduction of the total suction force at the concurrent suction.

Modification Example 3-3

Figure 27A:
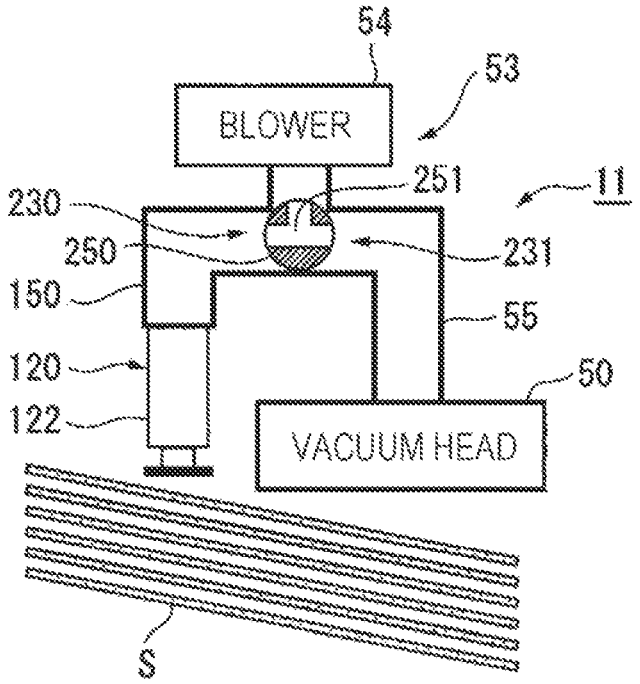
FIG. 27A is a diagram of a related portion of a medium feeding device according to a modification example 3-3.

FIG. 27A illustrates a related portion of a medium feeding device according to a modification example 3-3.

In FIG. 27A, the basic structure of the medium feeding device 11 is substantially the same as those of the modification examples 3-1 and 3-2, and includes a T-shaped space 231 and a common valve 230, but differs from those of the modification examples 3-1 and 3-2 in the structure of the common valve 230.

In this example, the common valve 230 includes a spherical valve body 250 rotatably disposed at the junction of the T-shaped space 231, and the valve body 250 has a T-shaped air flow path 251.

Figure 27B:
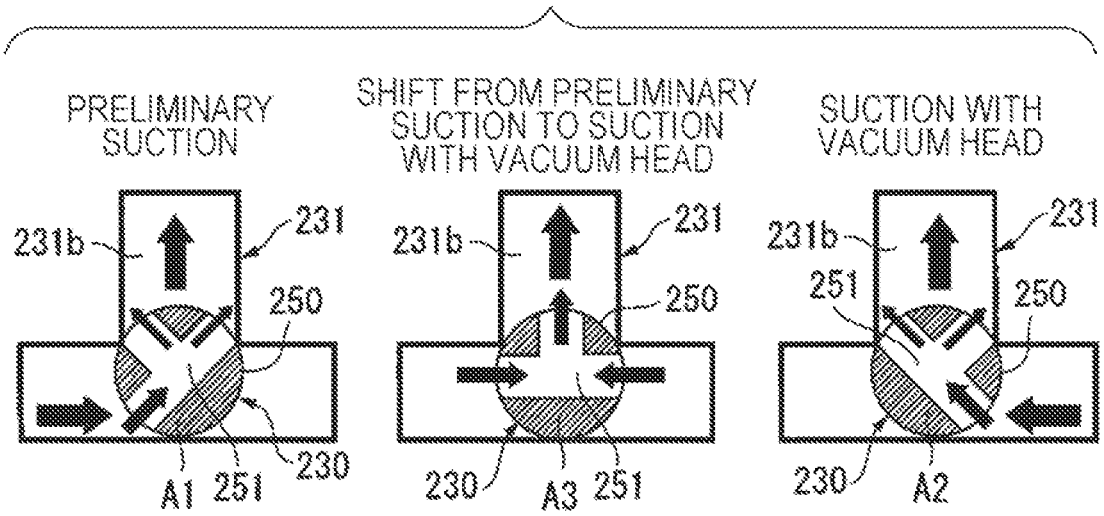
FIG. 27B is a diagram of a valve that controls air suction and the operation examples of the valve.

As illustrated in FIG. 27B, the common valve 230 shuts, with the valve body 250, the connection duct 55 continuous with the vacuum head 50 when the auxiliary suction device 120 performs preliminary suction, and rotates the valve body 250 to a first rotation position A1 to connect the air flow path 251 to the diverging connection duct 150 and a vertical space 231*b* including a junction in the T-shaped space 231. When the vacuum head 50 performs suction, the common valve 230 shuts the diverging connection duct 150 with the valve body 250, and rotates the valve body 250 to the second rotation position A2 to connect the air flow path 251 to the connection duct 55 continuous with the vacuum head 50 and the vertical space 231*b* including the junction of the T-shaped space 231.

In addition, when the preliminary suction is shifted to the operation performed by the vacuum head 50, the common valve 230 rotates the valve body 250 to a third rotation position A3, to locate the air flow path 251 to connect the T-shaped space 231 to the diverging connection duct 150 and the connection duct 55. In this case, the auxiliary suction device 120 and the vacuum head 50 are concurrently allowed to perform suction, and the total suction force at the concurrent suction is retained without being reduced.

Fourth Exemplary Embodiment

Figure 28A:
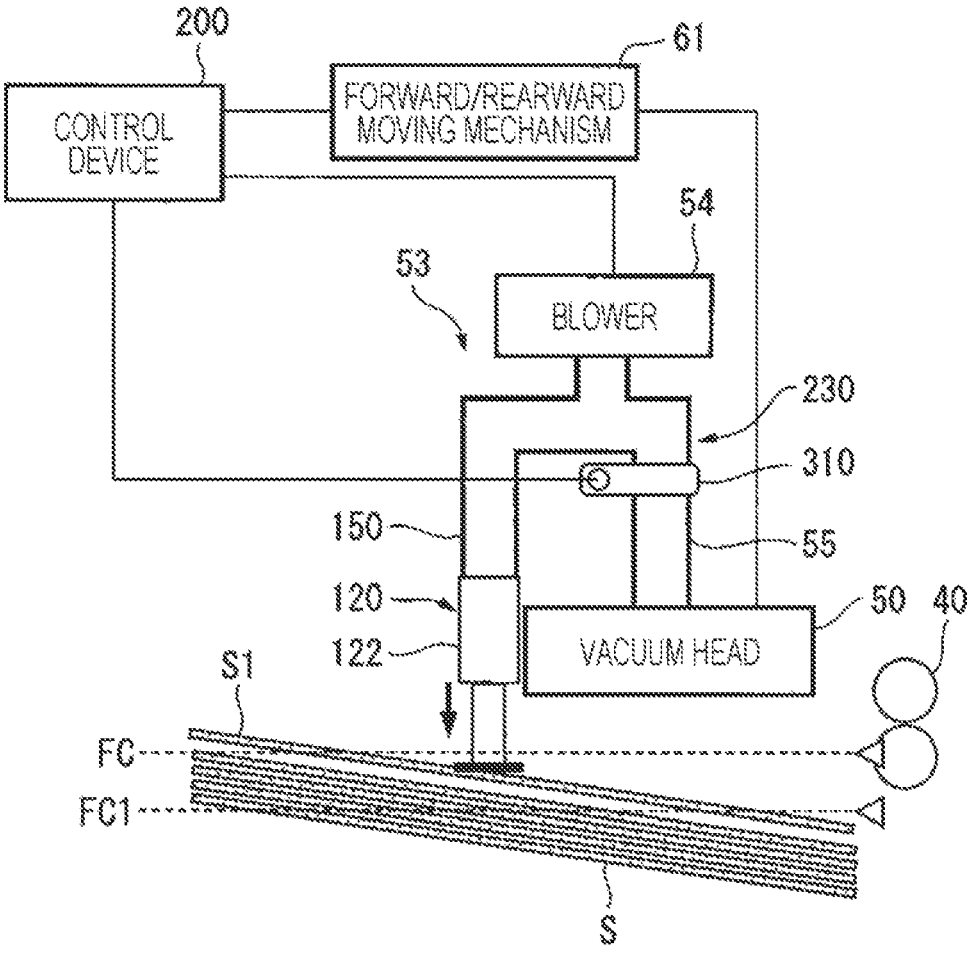
FIG. 28A is a diagram of a related portion of a medium feeding device according to a fourth exemplary embodiment.

FIG. 28A is a rough diagram of a medium feeding device according to a fourth exemplary embodiment.

In FIG. 28A, the basic structure of the medium feeding device 11 is substantially the same as those of the modification examples 3-1 to 3-3 obtained by modifying the third exemplary embodiment, and controls the air suction operation performed by the vacuum head 50 and the auxiliary suction device 120 with the common valve 230, but differs from the modification examples 3-1 to 3-3 obtained by modifying the third exemplary embodiment in the air suction operation performed by the auxiliary suction device 120. The auxiliary suction device 120 and other components are the same as those of the first exemplary embodiment.

Specifically, in this example, the common valve 230 includes a valve switch 310 that selectively switches between a flow path of the connection duct 55 located closer to the vacuum head 50 than a diverging portion between the connection duct 55 and the diverging connection duct 150, and a flow path of the diverging connection duct 150.

Figure 28B:
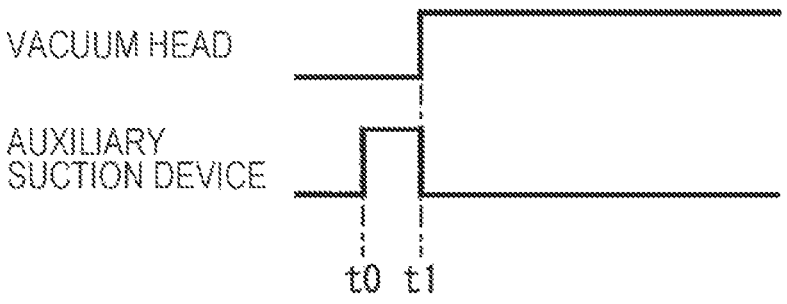
FIG. 28B is a timing chart of the air-suction operation performed by the vacuum head and the auxiliary suction device.

As illustrated in FIG. 28B, the auxiliary suction device 120 starts the air suction operation at a timing to earlier than the vacuum head 50. Thereafter, when the vacuum head 50 starts the air suction operation at a timing t1, the auxiliary suction device 120 concurrently finishes the air suction operation.

Figure 29A:
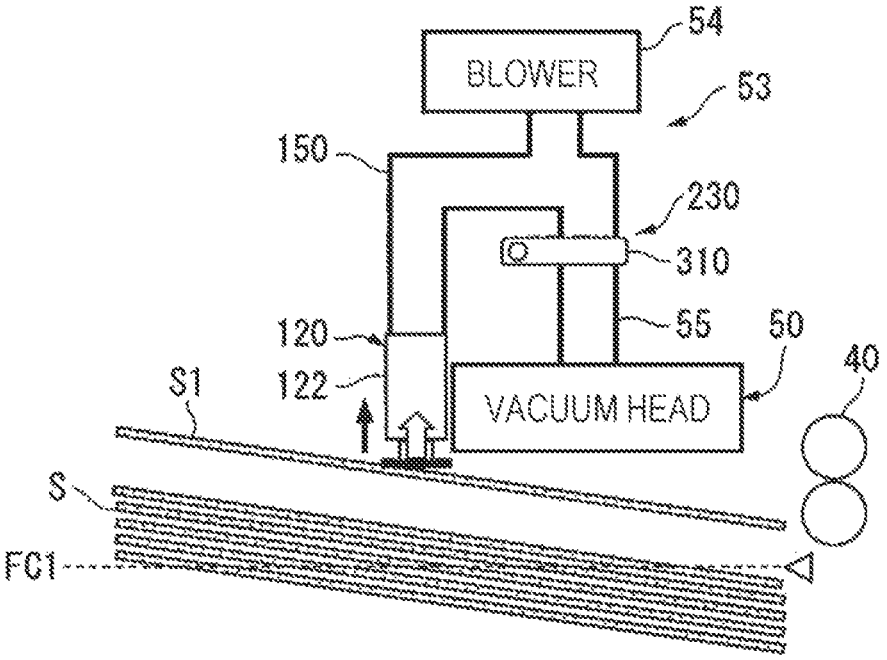
FIG. 29A is a diagram of a medium air-suction operation procedure performed by an auxiliary suction device of the medium feeding device according to the fourth exemplary embodiment.

In the present exemplary embodiment, as illustrated in FIG. 29A, when the auxiliary suction device 120 performs preliminary suction, the auxiliary suction device 120 extends to a lower position to the position FC1 lower than the medium reference height FC under its own weight, and comes into contact with the uppermost medium S1. Then, the auxiliary suction device 120 sucks and holds the medium S1 to raise the medium S1 to the upper position.

In this state, the medium S1 sucked and held by the auxiliary suction device 120 is located at a position close to the suction surface of the vacuum head 50.

Figure 29B:
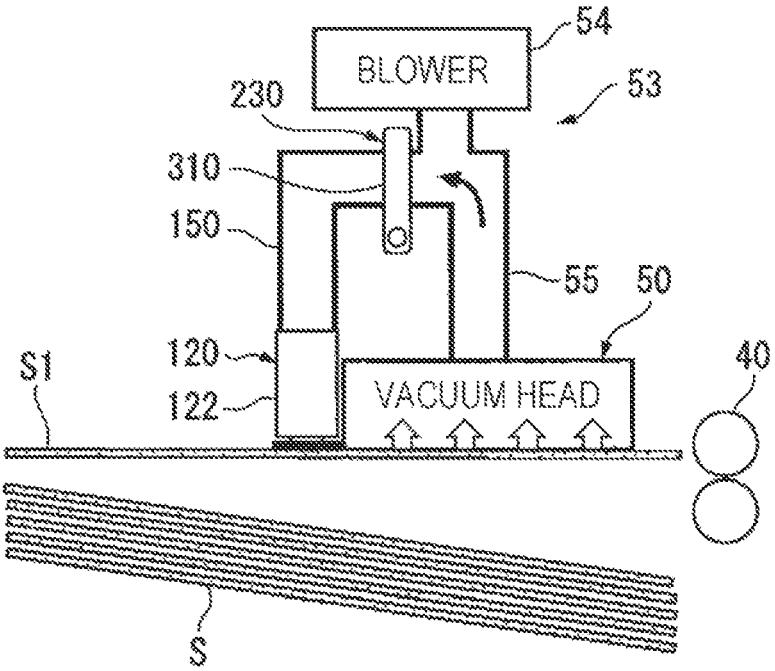
FIG. 29B is a diagram of the medium air-suction operation procedure performed by a vacuum head in the medium feeding device.

Thereafter, as illustrated in FIG. 29B, with a switching operation of the valve switch 310 in the common valve 230, the vacuum head 50 starts the air suction operation, and concurrently, the auxiliary suction device 120 finishes the air suction operation.

When the auxiliary suction device 120 finishes the air suction operation, the auxiliary suction device 120 stops exerting the air suction force on the medium S1, but the vacuum head 50 immediately starts the air suction operation, and starts exerting the air suction force on the medium S1. Thus, the medium S1 sucked and held by the auxiliary suction device 120 is switched to be immediately sucked and held by the vacuum head 50. Thus, as in the present example, regardless of when the air suction operation is selectively switched from the auxiliary suction device 120 to the vacuum head 50, the auxiliary suction device 120 assists the vacuum head 50 in air-suction operation of the medium S1.

Fifth Exemplary Embodiment

Figure 30:
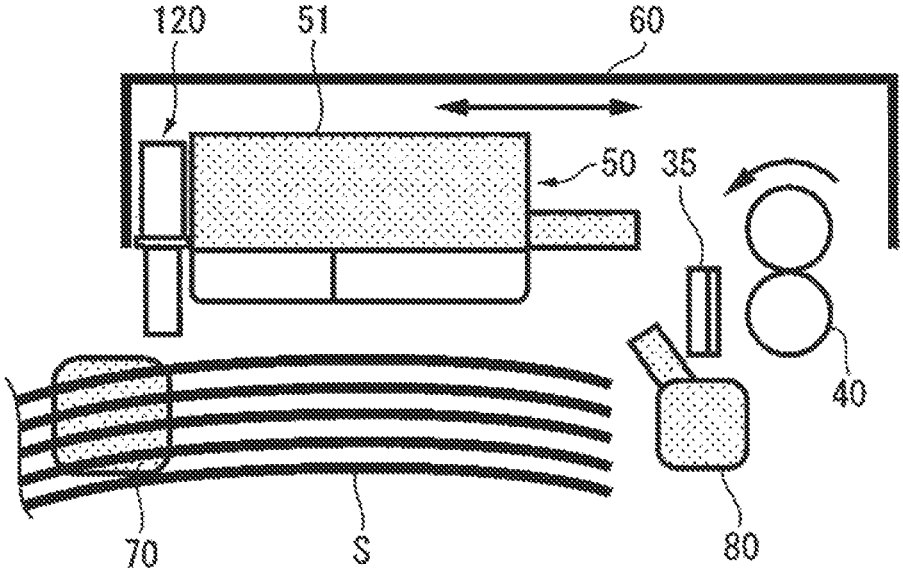
FIG. 30 is a diagram of a related portion of a medium feeding device according to a fifth exemplary embodiment.

FIG. 30 illustrates a related portion of a medium feeding device according to a fifth exemplary embodiment.

In FIG. 30, the basic structure of the medium feeding device 11 is substantially the same as those of the first to fourth exemplary embodiments, but differs from those of the first to fourth exemplary embodiments in that the auxiliary suction device 120 is disposed at a portion of the head body 51 in the vacuum head 50 to move forward and rearward together with the vacuum head 50.

In this example, the basic structure of the auxiliary suction device 120 is substantially the same as, for example, that of the first exemplary embodiment, but differs from that of the first exemplary embodiment in the air suction operation performed by the auxiliary suction device 120.

Figure 31A:
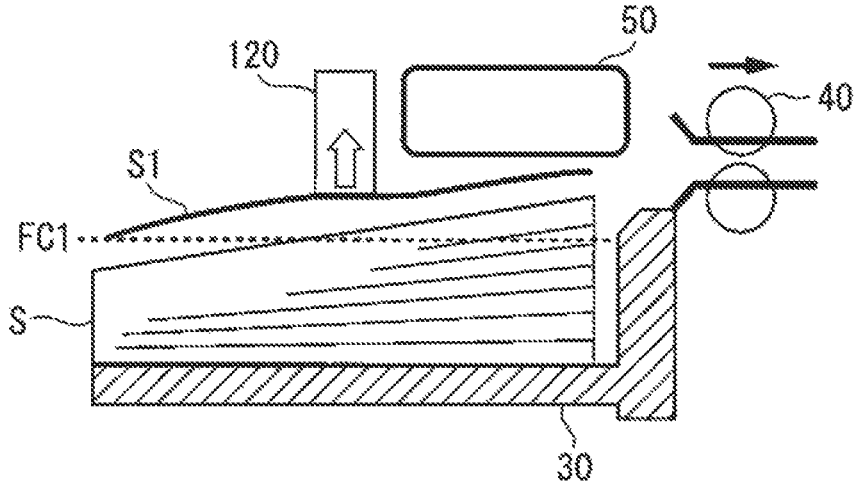
FIG. 31A is a diagram of a medium air-suction operation procedure performed by an auxiliary suction device of the medium feeding device according to the fifth exemplary embodiment.
Figure 31B:
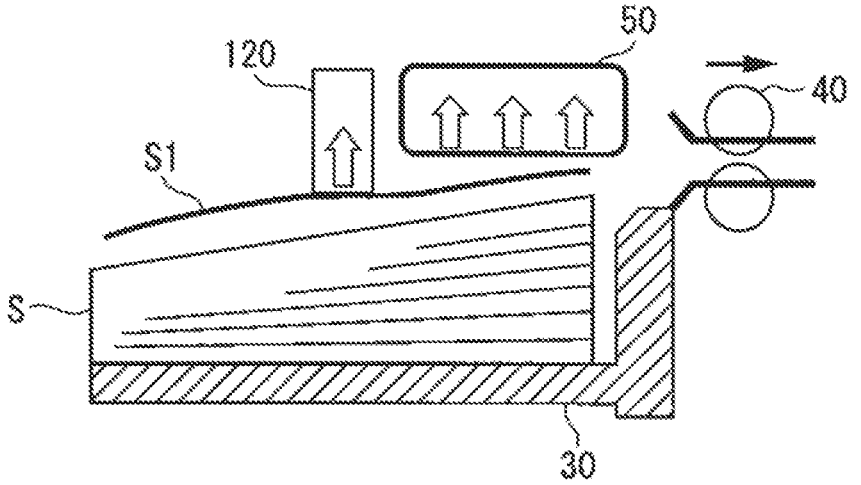
FIG. 31B is a diagram of the medium air-suction operation procedure performed with a vacuum head in the medium feeding device.
Figure 31C:
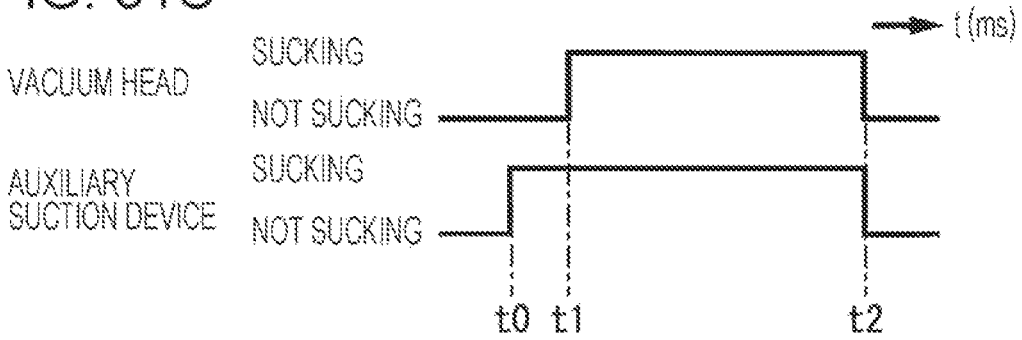
FIG. 31C is a timing chart of the air-suction operation performed with the vacuum head and the auxiliary suction device.

Specifically, in this example, as illustrated in FIG. 31C, the auxiliary suction device 120 starts the air suction operation at the timing to earlier than the vacuum head 50, continues performing the air suction operation also after the vacuum head 50 starts the air suction operation at the timing t1, and finishes the air suction operation at the timing t2 when the vacuum head 50 finishes the air suction operation.

As illustrated in FIG. 31C, according to the present exemplary embodiment, when the auxiliary suction device 120 performs preliminary suction, as illustrated in FIG. 31A, the auxiliary suction device 120 extends downward under its own weight toward the position FC1 lower than the medium reference height FC, and comes into contact with the uppermost medium S1. The auxiliary suction device 120 then sucks and holds the medium S1, and raises the medium S1 to the upper position.

In this state, the medium S1 sucked and held by the auxiliary suction device 120 is located close to the suction surface of the vacuum head 50.

Thereafter, as illustrated in FIG. 31C, when the vacuum head 50 starts the air suction operation, as illustrated in FIG. 31B, the medium S1 sucked and held by the auxiliary suction device 120 is sucked by the vacuum head 50 with air. Thus, the medium S1 sucked with air by both the vacuum head 50 and the auxiliary suction device 120 is handed over to the discharging rollers 40 with the movement of the vacuum head 50 toward the discharging rollers 40.

In this case, when the medium S1 is handed over to the discharging rollers 40, the vacuum head 50 and the auxiliary suction device 120 finish the air suction operation, and return to the initial positions.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium feeding device, comprising:

a container member that accommodates sheet media;

a discharging member disposed further than the media accommodated in the container member in a discharging direction in which the media are discharged, to discharge the media one by one;

a hand-over member disposed above the container member at a position closer to the discharging member to suck the media accommodated in the container member with air and pass the media to the discharging member;

a floating device disposed on a side of the media accommodated in the container member to blow air to an upper area of a side end surface of the media and float the media while an upper portion of the media is separated; and an auxiliary suction member disposed above the container member on a side of the hand-over member opposite to a side closer to the discharging member in the discharging direction in which the media are discharged, such that a downstream edge of the auxiliary suction member is upstream of an upstream-most edge of the hand-over member, to suck the media accommodated in the container member with air, wherein the auxiliary suction member is disposed at a first distance from the hand-over member, and is disposed at a second distance from an end portion of the media accommodated in the container member opposite to an end portion of the media located closer to the discharging member, the first distance being less than the second distance, and wherein the auxiliary suction member includes a moving duct having a lower end portion vertically movable, and moves the moving duct to a predetermined lower target position to start an air-suction operation.

2. The medium feeding device according to claim 1, wherein the auxiliary suction member sucks the media accommodated in the container member with air earlier than the hand-over member sucks the media.

3. The medium feeding device according to claim 1, wherein, on condition that media with a uniform thickness are accommodated in the container member in a substantially horizontal position, when a position where an uppermost position of the media is set for the hand-over member to be capable of performing an air-suction operation on the media is defined as a medium reference height, the auxiliary suction member sucks the media with air at a position lower than the medium reference height.

4. The medium feeding device according to claim 1, wherein the auxiliary suction member starts an air-suction operation earlier than the hand-over member performs an air-suction operation.

5. The medium feeding device according to claim 1, wherein the auxiliary suction member starts an air-suction operation earlier than the hand-over member starts an air-suction operation, and finishes the air-suction operation after the hand-over member starts the air-suction operation.

6. The medium feeding device according to claim 1, wherein the auxiliary suction member is continuous to an air suction member through a flow-path forming portion, and an opening-degree adjusting member that opens and shuts a flow path formed from the flow-path forming portion is disposed in the flow-path forming portion.

7. The medium feeding device according to claim 6, wherein the air suction member is provided separately from an air suction member for the hand-over member to perform an air-suction operation.

8. The medium feeding device according to claim 6, wherein the air suction member also functions as an air suction member for the hand-over member to perform an air-suction operation.

9. The medium feeding device according to claim 8, wherein the flow-path forming portion includes a first flow-path forming portion that connects the air suction member and the hand-over member to each other, and a second flow-path forming portion that diverges from a portion of the first flow-path forming portion to be connected to the auxiliary suction member, and wherein the opening-degree adjusting member includes a first opening-degree adjusting portion disposed at a portion of the first flow-path forming portion closer to the hand-over member than the portion diverging to be connected to the second flow-path forming portion to adjust a degree of opening, and a second opening-degree adjusting portion disposed at the second flow-path forming portion to adjust a degree of opening.

10. The medium feeding device according to claim 8, wherein the flow-path forming portion includes a first flow-path forming portion that connects the air suction member and the hand-over member to each other, and a second flow-path forming portion that diverges from a portion of the first flow-path forming portion to be connected to the auxiliary suction member, and wherein the opening-degree adjusting member includes a common-use opening-degree adjusting portion that is disposed at a diverging portion between the first flow-path forming portion and the second flow-path forming portion, and divides suction air among the auxiliary suction member and the hand-over member.

11. The medium feeding device according to claim 6, wherein after the opening-degree adjusting member switches to a first opening-degree mode that allows only the auxiliary suction member to perform an air-suction operation, the auxiliary suction member starts the air-suction operation, and after a predetermined time period has passed from when the auxiliary suction member starts the air-suction operation, the opening-degree adjusting member switches to a second opening-degree mode that allows, in addition to the auxiliary suction member, the hand-over member to perform the air-suction operation, and the hand-over member starts the air-suction operation.

12. The medium feeding device according to claim 1, wherein the target position is set lower than a medium reference height.

13. The medium feeding device according to claim 1, wherein the auxiliary suction member includes a vertically expandable moving duct, and extends the moving duct to the target position under own weight to start the air-suction operation.

14. The medium feeding device according to claim 1, wherein the auxiliary suction member includes a vertically movable moving duct and a driving member that vertically moves the moving duct, and moves the moving duct to the target position to start the air-suction operation.

15. The medium feeding device according to claim 1, wherein the auxiliary suction member includes a moving duct having a lower end portion vertically movable, and the moving duct includes an absorber that absorbs an excess of movement of the lower end portion.

16. The medium feeding device according to claim 1, wherein the auxiliary suction member includes an air suction area narrower than an air suction area of the hand-over member.

17. The medium feeding device according to claim 16, wherein the auxiliary suction member is located at a center of the media in a width direction crossing the discharging direction.

18. A medium processing device, comprising:

the medium feeding device according to claim 1; and a processing member that performs a predetermined process on the media fed from the medium feeding device.

* * * * *